US007205492B1

(12) United States Patent
Corcino et al.

(10) Patent No.: US 7,205,492 B1
(45) Date of Patent: Apr. 17, 2007

(54) PUSH BUTTON ACTUATOR

(75) Inventors: Baltazar S. Corcino, Chicago, IL (US); Brian M. Ott, Huntley, IL (US)

(73) Assignee: The Eastern Company, Wheeling, IL (US)

( * ) Notice: Subject to any disclaimer, the term of this patent is extended or adjusted under 35 U.S.C. 154(b) by 0 days.

(21) Appl. No.: 11/519,108

(22) Filed: Sep. 11, 2006

Related U.S. Application Data

(62) Division of application No. 11/079,400, filed on Mar. 14, 2005, now Pat. No. 7,126,066.

(51) Int. Cl.
*H01H 9/28* (2006.01)

(52) U.S. Cl. ..... 200/43.13; 200/566; 200/318.2; 200/520; 200/341; 70/360; 70/367; 292/129

(58) Field of Classification Search ..... 200/520, 200/341–345, 43.11, 43.18, 318.2, 11 R; 70/360–361, 367–371, 386–387; 292/123, 292/127, 129
See application file for complete search history.

(56) References Cited

U.S. PATENT DOCUMENTS

| | | | | |
|---|---|---|---|---|
| 113,070 | A | 3/1871 | Loeffelholz et al. | 292/34 |
| 417,589 | A | 12/1889 | Rose | 292/40 |
| 480,148 | A | 8/1892 | Theby | 292/36 |
| 491,824 | A | 2/1893 | Walker | 200/61.64 |
| 767,567 | A | 8/1904 | Keil | 292/127 |
| 876,300 | A | 1/1908 | Courlet | 292/135 |
| 925,455 | A | 6/1909 | Campbell | 70/81 |
| 1,058,346 | A | 4/1913 | Berstler | 292/21 |
| 1,174,652 | A | 3/1916 | Banks | 292/36 |
| 1,368,141 | A | 2/1921 | Hagstrom | 292/34 |
| 1,531,605 | A | 3/1925 | Gaynor | 200/535 |
| 1,556,864 | A | 10/1925 | Mendenhall | 292/33 |
| 1,571,453 | A | 2/1926 | Maxon | 262/170 |
| 1,611,940 | A | 12/1926 | Ohmer | 464/37 |
| 1,662,423 | A | 3/1928 | Jacobi | 70/360 |
| 1,672,901 | A | 6/1928 | North | 292/227 |
| 1,908,980 | A | 5/1933 | Heyel | 70/120 |
| 1,937,165 | A | 11/1933 | Piagneri | 70/53 |

(Continued)

*Primary Examiner*—Kyung Lee
(74) *Attorney, Agent, or Firm*—David A. Burge

(57) ABSTRACT

A push button actuator unit has a housing which defines a through passage that extends along an axis of the housing, and a slot that extends in a plane which transversely intersects the axis and communicates with the passage for supporting in the housing-defined slot a disc-shaped member having a central opening that aligns with the passage. Movable in the aligned passage and opening is a push button sub-assembly of the unit which includes a front element that, when depressed rearwardly, may cause a rear element of the push button sub-assembly to extend rearwardly from the housing to release a latch or to operate a switch or the like. If the unit is to be lockable, an optional locking mechanism is added to the elements of the push button sub-assembly to selectively drivingly connect the front and rear elements so that depression of the front element will cause rearward extension of the rear element only when the unit is unlocked. The disc-shaped member interacts with other components of the unit to regulate the movement of selected elements of the push button sub-assembly relative to the housing, for example by limiting element translation along the axis and/or by inhibiting the turning of selected elements of the push button sub-assembly about the axis.

15 Claims, 12 Drawing Sheets

U.S. PATENT DOCUMENTS

| | | | | |
|---|---|---|---|---|
| 1,965,939 | A | 7/1934 | Jacobi | 70/29 |
| 2,033,252 | A | 3/1936 | Parker | 200/11 |
| 2,059,479 | A | 11/1936 | North | 292/127 |
| 2,118,012 | A | 5/1938 | Lowe | 200/44 |
| 2,257,741 | A | 10/1941 | Gray | 70/85 |
| 2,261,472 | A | 11/1941 | Hurd | 70/455 |
| 2,322,040 | A | 6/1943 | Maruri | 70/145 |
| 2,580,548 | A | 1/1952 | Jacobi | 70/370 |
| 2,617,290 | A | 11/1952 | Schwartz | 70/452 |
| 2,623,959 | A | 12/1952 | Jarrett | 70/452 |
| 2,662,131 | A | 12/1953 | Cerna et al. | 200/44 |
| 2,683,978 | A | 7/1954 | Jacobi | 70/360 |
| 2,689,700 | A | 9/1954 | Drury | 248/27 |
| 2,695,932 | A | 11/1954 | Jacobi | 200/11 |
| 2,705,884 | A | 4/1955 | Craig | 70/264 |
| 2,728,214 | A | 12/1955 | Craig | 70/149 |
| 2,744,405 | A | 5/1956 | McClelland | 70/81 |
| 2,755,519 | A | 7/1956 | Xander | 20/52 |
| 2,772,908 | A | 12/1956 | Craig | 292/280 |
| 2,911,247 | A | 11/1959 | Corbin | 292/48 |
| 2,987,907 | A | 6/1961 | Cockburn et al. | 70/135 |
| 3,003,348 | A | 10/1961 | Jacobi | 70/84 |
| 3,054,634 | A | 9/1962 | Westerdale | 292/336.3 |
| 3,111,833 | A | 11/1963 | Dettmer | 70/140 |
| 3,146,010 | A | 8/1964 | Dellith | 292/212 |
| 3,285,043 | A | 11/1966 | Dauenbaugh et al. | 70/208 |
| 3,314,708 | A | 4/1967 | Welch | 292/336.5 |
| 3,599,455 | A | 8/1971 | Pilvet | 70/363 |
| 3,602,017 | A | 8/1971 | Bauer | 70/78 |
| 3,964,280 | A | 6/1976 | Kelton | 70/84 |
| 4,113,227 | A | 9/1978 | Cigliano | 151/54 |
| D265,965 | S | 8/1982 | Davis et al. | D8/6 |
| D270,328 | S | 8/1983 | Davis et al. | D8/6 |
| 4,488,669 | A | 12/1984 | Waters | 224/273 |
| 4,586,354 | A | 5/1986 | Smith | 70/451 |
| 4,635,454 | A | 1/1987 | Brown | 70/139 |
| 4,635,980 | A | 1/1987 | De Luca | 292/281 |
| 4,638,652 | A | 1/1987 | Morse et al. | 70/454 |
| 4,640,478 | A | 2/1987 | Leigh-Monstevens | 248/27.1 |
| 4,679,420 | A | 7/1987 | Yang | 70/422 |
| 4,773,240 | A | 9/1988 | Foshee | 70/222 |
| 4,794,772 | A | 1/1989 | Falk et al. | 70/491 |
| 4,803,314 | A | 2/1989 | Sorenson et al. | 200/11 |
| 4,899,561 | A | 2/1990 | Myers | 70/208 |
| 4,912,951 | A | 4/1990 | Weinerman et al. | 70/99 |
| 4,956,983 | A | 9/1990 | Okamura et al. | 70/241 |
| D312,769 | S | 12/1990 | Bisbing | D8/338 |
| 4,978,152 | A | 12/1990 | Bisbing | 292/169 |
| 5,018,373 | A | 5/1991 | Weinerman et al. | 70/99 |
| D318,217 | S | 7/1991 | Weinerman et al. | D8/331 |
| D324,635 | S | 3/1992 | Weinerman et al. | D8/331 |
| 5,212,972 | A | 5/1993 | Kincaid et al. | 70/208 |
| 5,308,126 | A | 5/1994 | Weger, Jr. et al. | 292/53 |
| 5,617,749 | A | 4/1997 | Park | 70/224 |
| 5,689,980 | A | 11/1997 | Weinerman et al. | 70/208 |
| 5,711,506 | A | 1/1998 | Stillwagon | 70/208 |
| 5,722,275 | A | 3/1998 | Price et al. | 70/379 |
| 5,730,014 | A | 3/1998 | Berger et al. | 70/422 |
| 5,787,743 | A | 8/1998 | Weigard | 70/422 |
| 5,799,520 | A | 9/1998 | Laabs et al. | 70/360 |
| 5,816,630 | A | 10/1998 | Bennett et al. | 292/341.17 |
| 5,901,836 | A * | 5/1999 | Taniuchi | 200/316 |
| 6,058,751 | A | 5/2000 | Dimig et al. | 70/419 |
| 6,067,827 | A | 5/2000 | Haseley et al. | 70/370 |
| 6,113,160 | A | 9/2000 | Johansson et al. | 292/169 |
| D431,998 | S | 10/2000 | Johansson et al. | D8/331 |
| D432,389 | S | 10/2000 | Johansson et al. | D8/331 |
| D433,309 | S | 11/2000 | Johansson et al. | D8/331 |
| D435,427 | S | 12/2000 | Sokurenko | D8/331 |
| 6,231,091 | B1 | 5/2001 | Gleason et al. | 292/34 |
| D445,015 | S | 7/2001 | Weinerman et al. | D8/302 |
| D447,042 | S | 8/2001 | Weinerman et al. | D8/330 |
| 6,410,871 | B1 * | 6/2002 | Rarbach | 200/336 |
| 6,425,275 | B1 | 7/2002 | Geurden | 70/422 |
| D463,247 | S | 9/2002 | Weinerman et al. | D8/330 |
| 6,454,320 | B1 | 9/2002 | Weinerman et al. | 292/56 |
| D464,555 | S | 10/2002 | Weinerman et al. | D8/330 |
| 6,463,774 | B2 | 10/2002 | Sokurenko | 70/360 |
| D467,786 | S | 12/2002 | Weinerman et al. | D8/330 |
| 6,523,382 | B1 | 2/2003 | Dimig et al. | 70/496 |
| D471,426 | S | 3/2003 | Weinerman et al. | D83/330 |
| D471,427 | S | 3/2003 | Weinerman et al. | D8/330 |
| D472,449 | S | 4/2003 | Weinerman et al. | D8/330 |
| D474,098 | S | 5/2003 | Weinerman et al. | D8/330 |
| D474,673 | S | 5/2003 | Weinerman et al. | D8/330 |
| 6,564,602 | B2 | 5/2003 | Gregory | 70/360 |
| 6,575,503 | B1 | 6/2003 | Johansson et al. | 292/170 |
| 6,640,592 | B2 | 11/2003 | Vickers | 70/83 |
| 6,686,551 | B2 * | 2/2004 | Pasotto | 200/566 |
| 6,711,924 | B2 | 3/2004 | Ritz | 70/422 |
| 6,755,449 | B2 | 6/2004 | Weinerman et al. | 292/198 |
| 6,782,725 | B2 | 8/2004 | Linares | 70/360 |

* cited by examiner

PUSH BUTTON ACTUATOR

CROSS-REFERENCE TO RELATED APPLICATION

This application is a division of application Ser. No. 11/079,400 filed Mar. 14, 2005 by Baltazar S. Corcino and Brian Ott, entitled PUSH BUTTON LOCK, now a U.S. Pat. No. 7,126,066 the disclosure of which is incorporated herein by reference.

BACKGROUND OF THE INVENTION

The present invention relates to a push button operating assembly or "push button actuator" of the type used in a variety of applications to operate an electrical switch, or to move a link to cause one or more latches to release so a closure can be opened, or to otherwise initiate or influence the operation of a device by causing an operating element of the device to move from one position to another.

More particularly, the invention relates to a push button actuator unit having a generally tubular housing which supports elements of a push button sub-assembly for translation in a housing-defined passage which extends along a central axis of the housing, wherein a disc-shaped member is mounted in a notch or slot of the housing that extends transverse to the axis, and wherein the disc-shaped member is used to regulate (i.e., limit, restrict, inhibit, resist or otherwise control) movement of selected elements of the push button sub-assembly. An optional locking mechanism may be included among the elements of the push button sub-assembly for selectively establishing and disestablishing a driving connection between front and rear elements of the push button sub-assembly to ensure that rearward extension of a rear element takes place in response to rearward depression of a front element only when the locking mechanism is unlocked.

Push button actuators of a variety of types have long been used to trip electrical switches, to release latches that hold closures in closed positions, and to initiate or otherwise influence the operation of various apparatus by causing operating elements of the apparatus to move from one position to another. Push button actuators used to release one or more latches that hold closures in closed positions typically include generally tubular housings that can be mounted on a closure or on structure extending about or adjacent to an opening that can be closed by the closure; and typically employ push button sub-assemblies which have elements that can move within central passages of their associated tubular housings. Each push button sub-assembly typically includes a front element that can be depressed rearwardly toward or into the central passage of a tubular housing to cause a rear element to extend rearwardly from the passage to move an operating element of a latch, or to move a link that releases plural latches.

If the push button actuator is to be "lockable," a locking mechanism usually is included among the elements of the push button sub-assembly. Some lockable push button actuators prevent rearward movement of all elements of their push button sub-assemblies when locked. A drawback of push button actuators of this type is that their locking actions sometimes can be defeated by forcefully depressing elements of their push button sub-assemblies, for example by hammering.

To prevent defeat by hammering, some push button sub-assemblies employ locking mechanisms that drivingly connect their front and rear elements only when unlocked.

By this arrangement, depression of a front element of the push button sub-assembly of an "unlocked" push button actuator will cause a rear element to move rearwardly to effect latch operation; but depression of the front element of the push button sub-assembly of a "locked" push button actuator unit will cause no rearward movement of a rear element and, therefore, should not cause latch operation even if front element depression is effected by hammering.

Regardless of whether any or all of the elements of a locked push button sub-assembly can be depressed, it may be possible to defeat the locking action of a push button actuator if front elements of the push button sub-assembly project sufficiently far forwardly from their associated housing passage to be gripped and turned by pliers, by a pipe wrench, or by some other tool or device that is capable of forcefully applying torque directly to these forwardly projecting elements. Likewise, it also may be possible to defeat the locking action of a push button actuator if a screwdriver, chisel or other flat-bladed tool can be inserted into a keyway of a front element and torqued with sufficient force to cause elements of the push button sub-assembly to turn to an unlocked or operated position, or to cause breakage of elements of the push button sub-assembly or other components of the push button actuator unit.

In an effort to provide key-lockable push button actuators that resist being defeated, when locked, by using tools such as pliers, pipewrenches, screwdrivers, chisels and the like to forcefully apply torque to push button sub-assembly elements, some proposals have provided push button sub-assemblies with elements that "free wheel" when forcefully torqued while locked. The addition of a "free wheeling" capability of this type is intended to enable locked push button sub-assembly elements that are forcefully torqued to rotate relative to their surrounding housings without causing push button operating mechanism breakage, and without causing the push button actuators to unlock, to operate, or initiate the operation of associated devices such as electrical switches or latches.

Although improvements have resulted as push button actuator unit designs have matured to provide enhanced resistance to hammering and defeat by overtorque force, problems and drawbacks remain that need to be addressed; and, in some instances, new designs have brought new problems and drawbacks that also need attention. To avoid defeat by hammering, many present-day push button actuator units employ sizable, heavy-duty components that are costly, difficult to manufacture, difficult to assemble and/or result in bulky units that are not well suited for use in applications where available space is restricted, for example, in tool boxes. Attempts to provide push button actuator units with sturdy "stop surfaces" that limit the forward-rearward movements of selected elements of push button sub-assemblies have, in some instances, generated multi-component solutions that are less than elegant. Some push button actuator unit proposals that employ push button sub-assembly elements which are designed to "free wheel" in response to overtorque cannot be fully or properly reset to return the units to normal operation after their push button sub-assembly elements have been forced even one time to "free wheel," hence these units are designed to withstand only one overtorque experience that causes element free wheeling, whereafter the units require repair or replacement if normal operation is to be restored.

SUMMARY OF THE INVENTION

The present invention addresses the foregoing and other problems, drawbacks and deficiencies by providing push button actuator units that utilize a simple, compact and relatively inexpensive set of components, and that employ a novel and improved approach in regulating the movement of selected elements of their push button sub-assemblies—elements that are movable within the central passages of the generally tubular housings of the push button actuator units.

In preferred practice, a push button actuator unit having a housing which defines a through passage which extends along a central axis of the housing is provided with a housing-defined slot that extends in a plane which transversely intersects the central axis and communicates with the passage for supporting in the housing-defined slot a disc-shaped member having a central opening that aligns with the passage. Movable in the aligned passage and opening is a push button sub-assembly of the unit which includes a front element that, when depressed rearwardly, may cause a rear element of the push button sub-assembly to extend rearwardly from the housing to release a latch or to operate a switch or the like. If the unit is to be lockable, an optional locking mechanism is added to the elements of the push button sub-assembly to selectively drivingly connect the front and rear elements so that depression of the front element will cause rearward extension of the rear element only when the unit is unlocked.

In the preferred practice of the invention, the disc-shaped member interacts with other components of the unit to regulate (i.e., to limit, restrict, inhibit, resist or otherwise control) the movement of selected elements of the push button sub-assembly relative to the housing, for example by limiting element translation along the central axis of the housing and/or by inhibiting the turning of selected elements of the push button sub-assembly about the central axis.

In some embodiments of the invention, the disc-shaped member provides a stop surface that is engaged by one or more of the elements to limit or restrict element movement within the central passage of the housing, for example as a "stop" that limits axial translatory movement of front and/or rear elements of the push button sub-assembly. In other embodiments of the invention, push button sub-assembly element movement is regulated by inhibiting it, for example by providing a detent that prevents turning of elements about the central axis of the housing until a force tending to initiate movement is of sufficient magnitude to cause detent release as, for example, when push button sub-assembly elements are permitted to free wheel to prevent damage to a push button actuator unit when defeat or damage by overtorque is attempted. In some embodiments, the disc-shaped member not only serves as an axial translation "stop" but also cooperates with a biased detent to control turning of elements of the push button sub-assembly and can, if desired, provide a free-wheeling capability that prevents the push button actuator from being defeated as the result of overtorque force being applied to elements of the push button sub-assembly.

If the capability of a push button actuator unit to free wheel is to function only on a one-time-only basis in response to overtorque force, a detent biasing component formed from resilient material that collapses under pressure may be used to provide a detent that normally prevents elements of the push button sub-assembly from turning when "locked," but which will substantially collapse to permit harmless turning of elements of the push button sub-assembly elements when subjected to torque force by someone who believes that forcibly turning the push button sub-assembly elements will defeat the locking action of the push button actuator. If the detent or detents that permit free wheeling is/are to be resettable after an overtorque experience has caused elements to free wheel, a non-collapsible biasing component is chosen so that, once components of actuator unit have been realigned in a way that permits the detent action to reestablish, normal detent action can resume.

In some embodiments of the invention, separate front and rear compression coil springs are provided to separately bias front and rear elements of the push button sub-assembly in a forward direction along the central axis of the housing passage in which the elements of the push button sub-assembly are movably carried—so a front element is biased toward its normal, non-depressed position, and so a rear element is biased toward a non-rearwardly-extended position where the rear element may engage a rear side of the disc-shaped member.

In some embodiments, the locking mechanism that comprises one of the elements of the push button sub-assembly is provided with a radially outwardly biased bolt that, once a front element of the push button sub-assembly has been depressed into the housing passage, snaps radially outwardly within the housing passage to prevent return movement of the front element to its normal, non-depressed position unless and until the locking mechanism has been turned about the central axis to an unlocked orientation, which enables the front element to move under the influence of the front spring to a normal, non-depressed position.

BRIEF DESCRIPTION OF THE DRAWINGS

These and other features, and a fuller understanding of the invention will be better understood in view of the description and claims that follow, taken together with the accompanying drawings, wherein:

DESCRIPTION OF INVENTION EMBODIMENTS

Figure 1:
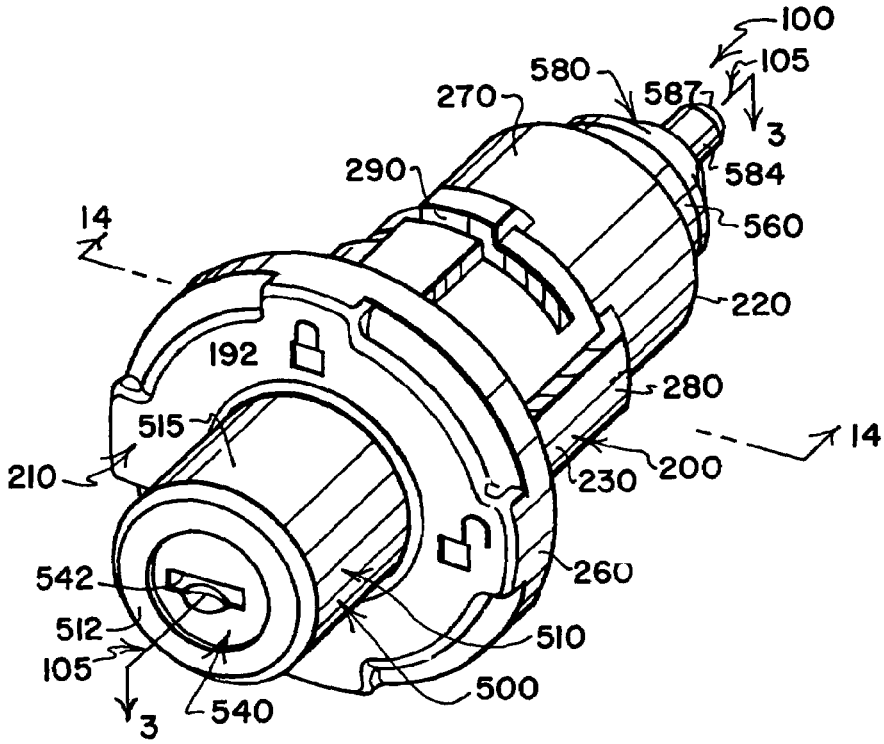
FIG. 1 is a perspective view showing a push button actuator unit with a lockable push button thereof in a normal, non-operated position, with a depressible front portion of the push button projecting forwardly from a central passage of the unit's housing, with a keyway of the push button turned to an unlocked position, and with a rear plunger portion of the push button withdrawn to its normal, non-extended, non-operated position.

Referring to FIGS. 1–12, a push button actuator unit embodying features of the preferred practice of the present invention is indicated generally by the numeral 100. The unit 100 has a tubular housing 200, front and rear surfaces of which are indicated by the numerals 210, 220, respectively. An internal passage 205 extends centrally through the housing 200 along an imaginary central axis 105, and opens through the front and rear surfaces 210, 220.

The housing 200 has a complexly configured exterior defined in large measure by an outer surface 230 that extends between the front and rear surfaces 210, 220. Included among exterior formations of the housing 200 that are bounded by the outer surface 230 are a substantially annular front bezel 260, a substantially cylindrical rear portion 270, and a central portion 280 situated between the front bezel 260 and the rear portion 270.

A relatively thin slot 290 is formed in the central portion 280 of the housing 200 and opens through the housing's outer surface 230. Due to the way the housing 200 is oriented in the depictions of FIGS. 1–12 and elsewhere in the drawings, the slot 290 is seen to open upwardly through the outer surface 230. The slot 290 extends in an imaginary plane that transversely (i.e., substantially perpendicularly) intersects the central axis 105.

Figure 19:
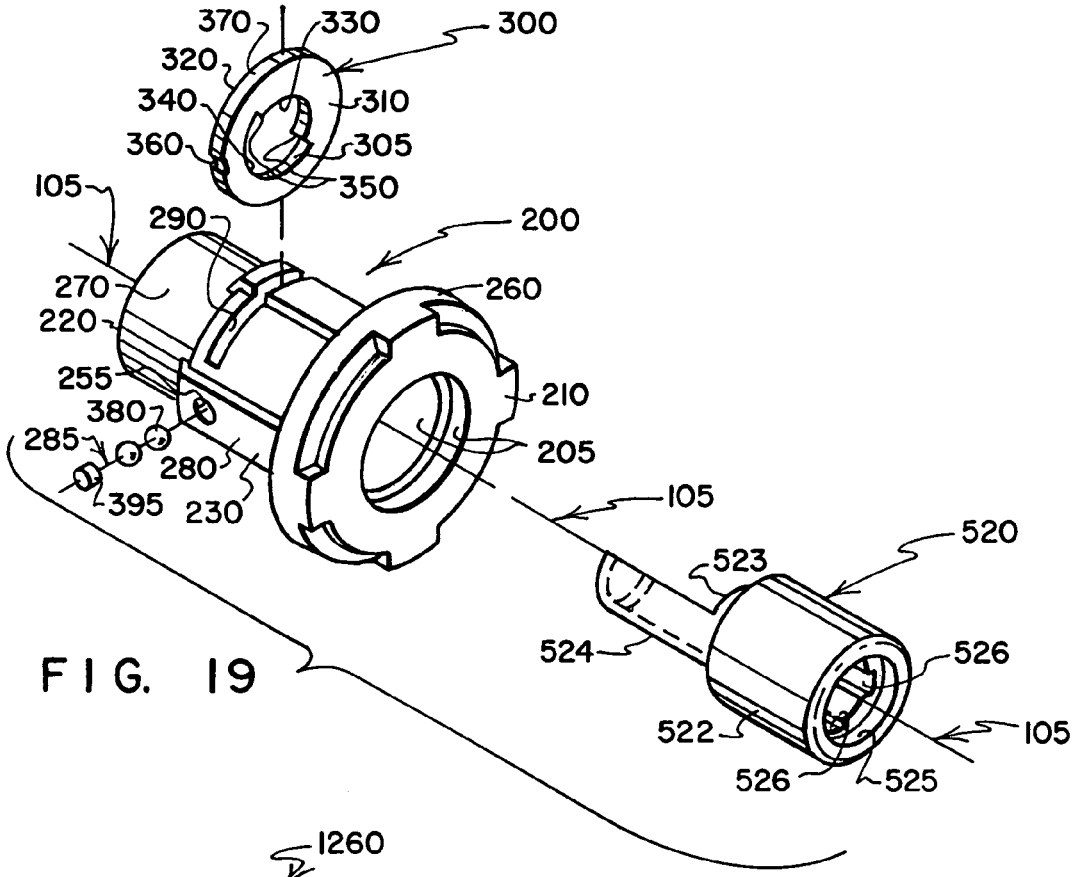
FIG. 19 is an exploded perspective view of selected elements of the push button actuator unit of FIGS. 1–18, including detent components.
Figure 21:
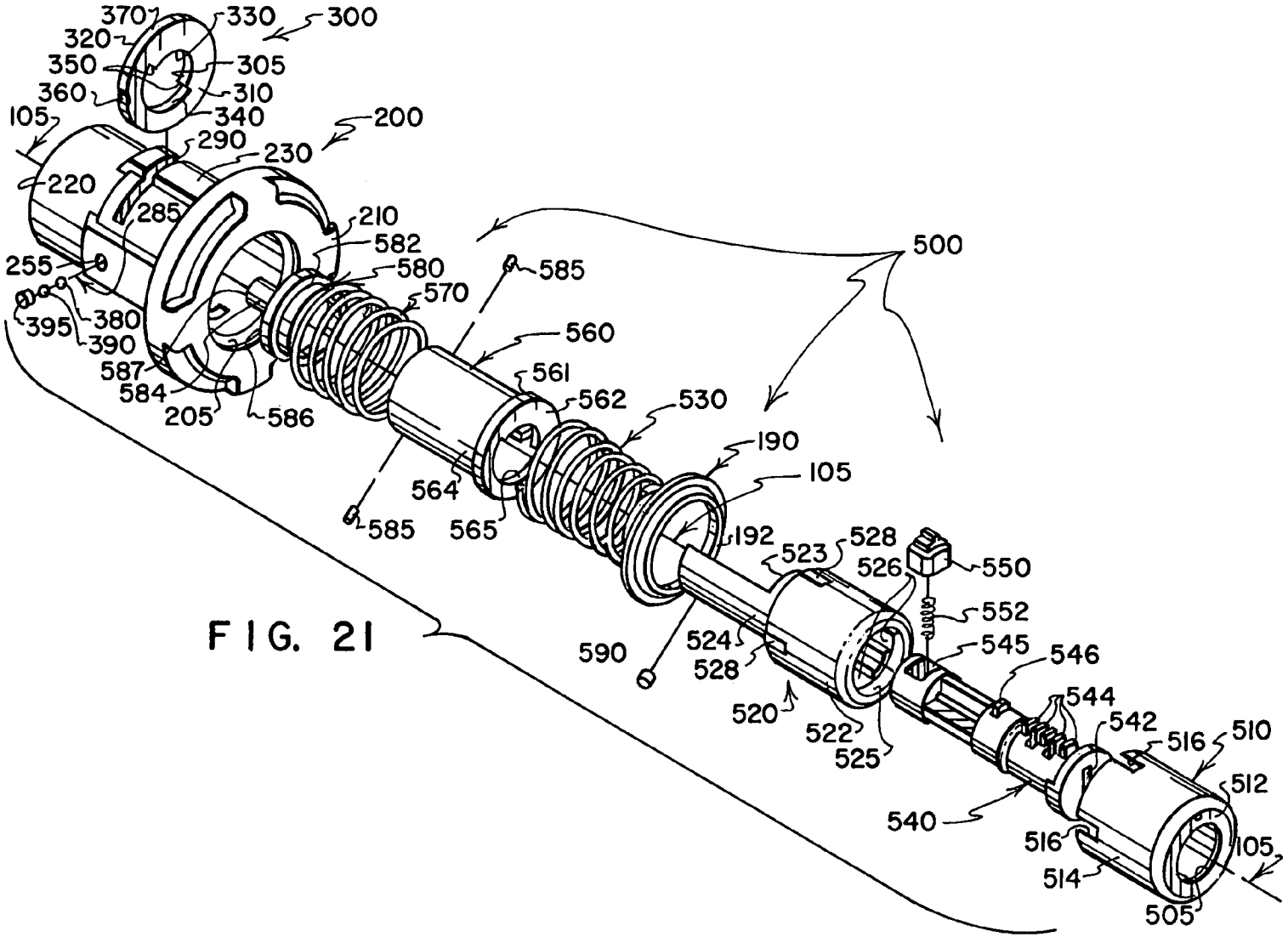
FIG. 21 is an exploded perspective view of components of the push button actuator unit of FIGS. 1–19; and, FIG. 22 is an exploded perspective view on an enlarged scale showing selected components of the push button sub-assembly of the push button actuator unit of FIGS. 1–19.

As can be seen in FIGS. 2, 3, 5, 6, 8, 9, 11 and 12, the slot 290 crosses the central passage 205 of the housing and serves to house and support a disc-shaped member 300, the preferred configuration of which is best seen in FIGS. 19 and 21. Referring to FIGS. 19 and 21, the disc-shaped member 300 is substantially flat, having opposed front and rear surfaces 310, 320 that extend in spaced, substantially parallel planes. The width of the slot 290 and the thickness of the disc-shaped member 300 are selected to provide a slip fit mounting in the slot 290 of the disc-shaped member 300 that permits the disc-shaped member 300 to turn in the slot 290 about the central axis 105.

A central opening 305 is formed through the disc-shaped member 300. When the disc-shaped member 300 is properly positioned in the slot 290, the opening 305 aligns with and communicates with the central passage 205 of the housing 200 so that elements of a push button sub-assembly 500 (depicted in FIG. 21) can move along the central axis 105 through portions of the aligned passage and opening 205, 305.

Figure 22:
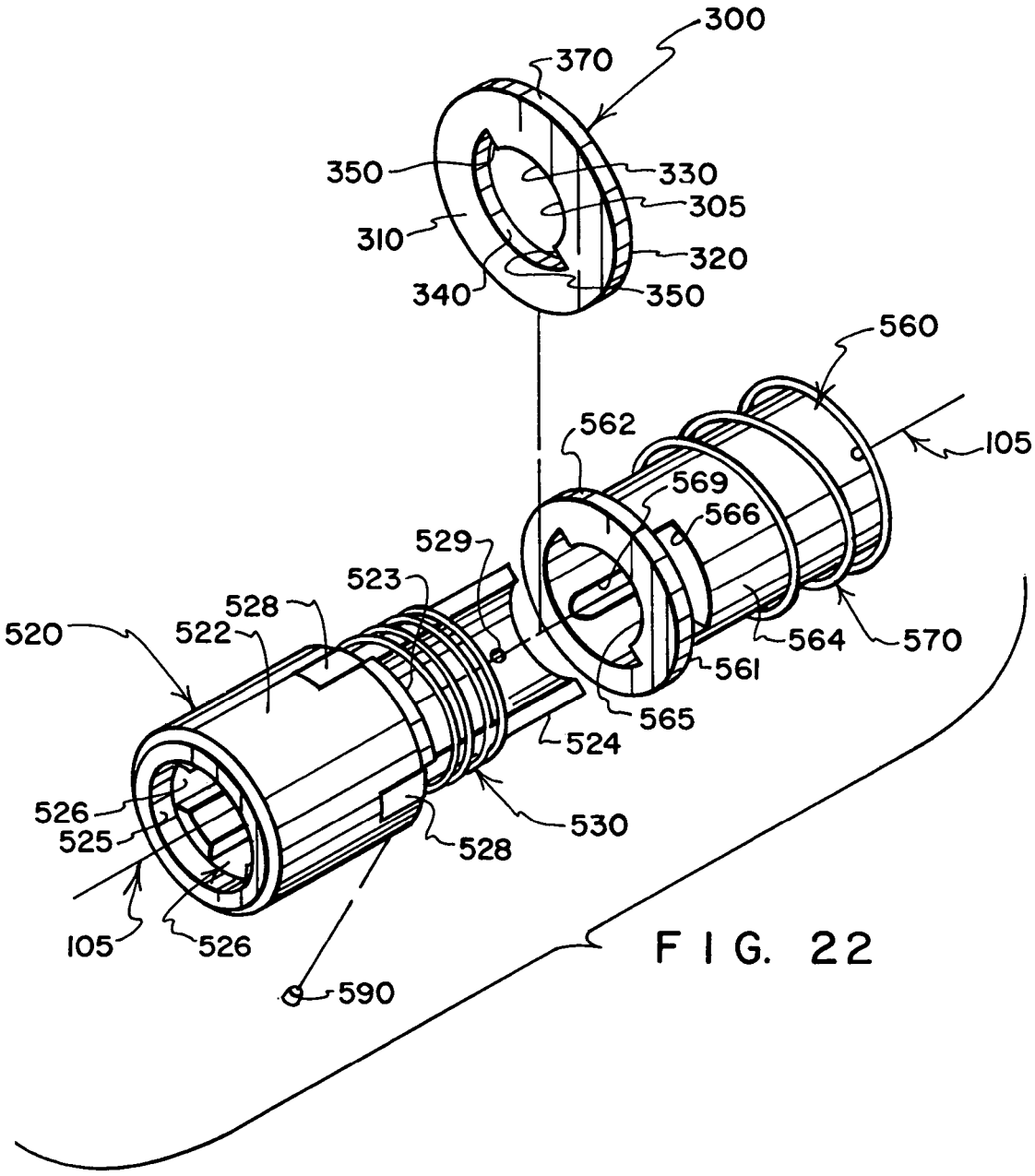

Referring to FIGS. 19, 21 and 22, the central opening 305 of the disc-shaped member 300 is defined by a pair of substantially semi-circular, substantially C-shaped surfaces 330, 340 that are of unequal radii. The C-shaped semi-circular surface 330 has a radius of curvature that is smaller than the radius of curvature of the C-shaped semi-circular surface 340. Flat surfaces 350 extending substantially radially with respect to the central axis connect adjacent end regions of the C-shaped surfaces 330, 340. In essence, the C-shaped surfaces 330, 340 divide the opening 305 into a smaller "half" bounded by the small-radius curved surface 330, and a larger "half" bounded by the large-radius curved surface 340.

Referring to FIGS. 21 and 22, the reason why the central opening 305 of the disc-shaped member 300 is configured in the manner just described is to enable the opening 305 to provide exterior or "female" elements of a spline-type connection that is used to drivingly connect the disc-shaped member 300 to two major elements of the push button sub-assembly 500, namely a primary front element 520 and a primary rear element 560.

Referring to FIGS. 21 and 22, the primary front element 520 has a generally cylindrical front portion 522, and a rearwardly extending substantially C-shaped rear portion 524 that is sized to be received in a slip fit within the larger "half" of the opening 305 of the disc-shaped member 300. The primary rear element 560 has a substantially annular front flange 562 with an outer diameter that is received in a slip fit within front portions of the housing passage 205, but which is too large to pass through a rear end region of the housing passage 205 where a smaller diameter opening 284 (see FIGS. 3, 6, 9 and 12) is defined by a rear wall 285 of the housing 200.

An opening 565 is formed centrally through the front flange 562 of the primary rear element 560. The opening 565 is substantially the same size and shape as the opening 305 formed through the disc-shaped member 300. Because the openings 305, 565 are identical, the opening 565 and can be thought of as having smaller and larger "halves" just as does the opening 305—an arrangement that permits each of the oddly configured openings 305, 565 to define external or "female" portions of a spline-type connection that drivingly connects the components 300, 520, 560.

The C-shaped cross-section of the rear portion 524 of the primary front element 520 is sized and configured to be received in a slip-fit inside the larger "halves" of the identical openings 305, 565 of the components 300, 560. This permits the rear portion 524 to serve as the interior or "male" element of the spline-type connection that drivingly connects the components 300, 520, 560. The resulting spline-type connection accomplishes two objectives, namely 1) to connect the components 300, 520, 560 in a way that permits the spline-connected members 300, 520, 560 to translate freely along the central axis 105 relative to each other, and 2) to connect the components 300, 520, 560 in a manner ensuring that, if any one of the spline-connected members 300, 520, 560 is caused to turn about the central axis 105, all three of the spline-connected members 300, 520, 560 will be forced to turn in unison about the axis 105.

The use of spline-type connections between or among a plurality of components 1) to permit the spline-connected components to slide axially (i.e., to translate along an axis of the components) relative to each other, and 2) to prevent the spline-connected components from turning relative to each other (about the same axis along which the spline-connected components are permitted to translate) constitutes a mechanism and a technique that is well known to those who are skilled in the art. Also well known is that fact that spline-type connections can be established by employing components that have a wide variety of interfittable, slide-together formations. Thus it will be readily understood that the members 300, 520, 560 can be spline-connected by slide-together formations that differ in configuration from the formations that are disclosed herein, so long as the formations selected for use provide freely slidable connections that permit axial translation relative to each other of the spline-connected components 300, 520, 560 while also serving to minimize or eliminate relative turning of the spline-connected components 300, 520, 560 about the same axis along which the spline-connected components 300, 520, 560 can translate.

Elements of the push button actuator unit 100 that are employed by the push button sub-assembly 500 are depicted in FIG. 21. Referring to FIG. 21, these elements include the primary front element 520, the primary rear element 560, a front cover element 510 designed to fit closely over and to shroud much of the exterior of the cylindrical front portion 522 of the primary front element 520, a front spring element 530, a tumbler-carrying, keyway-defining plug 540 which defines a transversely extending passage 545 in which a transversely movable latch bolt 550 and a spring 552 are carried, a rear spring element 570, a rear plunger element 580, a pair of connecting pins 585 insertable into aligned holes of the primary rear element 560 and the rear plunger element 580 to connect the elements 560, 580, and a pin 590 (see FIGS. 21, 22) having an inner end configured to be inserted into a hole 529 (see FIG. 22) formed through the rear portion 524 of the primary front element 520, and an outer end configured to extend in a slip-fit into an axially extending slot 569 (see FIG. 22) of the primary rear element to connect the elements 520, 560 for translation along the axis 105 relative to each other through a limited range of movement which causes the outer end of the pin 590 to move along the length of the slot 569.

Referring to FIG. 21, the front cover element 510 preferably is formed from a material that exhibits a distinctive color which causes depressible front portions of the push button sub-assembly 500 to present a prominent appearance. The front cover element 510 has an annular front portion 512 with an opening 505 formed therethrough which is of sufficient size to provide unobstructed access to a keyway 542 defined by a tumbler-carrying plug 540 designed to be inserted into central passage 525 of the primary front element 520, and has a generally cylindrical portion 514 designed to closely overlie and shroud the cylindrical front portion 522 of the primary front element 520. The generally cylindrical portion 514 provides a smooth outer surface 515 except where notches 516 are provided near the rear of the cylindrical portion 514 to engage projections 528 that are provided near the rear of the rear portion 524 of the primary front element 520. When the cover element 510 is installed on the front portion 522 of the primary front element 520, the front cover element 510 is prevented from turning about the axis 105 relative to the primary front element 520 by the projections 528 (see FIG. 21) extending into the notches 516.

When elements of the push button sub-assembly 500 are installed in the passage 205 of the housing 200, the smooth outer surface 515 of the front cover element 510 is engaged by a resilient wiper-washer 190 which serves as a seal to prevent moisture, dirt, dust and debris from entering interior portions of the passage 205. As is shown in FIGS. 2, 3, 5, 6, 8, 9, 11 and 12, the housing 200 is provided with an annular groove 195 that opens into front portions of the passage 205 that supports the resilient wiper-washer 190. When installed in the groove 195, the a forwardly extending lip 192 of the wiper-washer 190 engages the smooth outer surface 515 of the front cover element 510 of the push button sub-assembly 500.

Referring to FIGS. 3, 6, 9 and 12, the primary front element 520 of the push button sub-assembly 500 defines an annular, rearwardly-facing recess 521 designed to receive front portions of the front spring element 530. Other portions of the front spring element 530 surround the C-shaped cross-section of the rear portion 524 of the primary front element. A rear portion of the front spring element 530 engages the front face 310 of the disc-shaped member 300.

Figure 20:
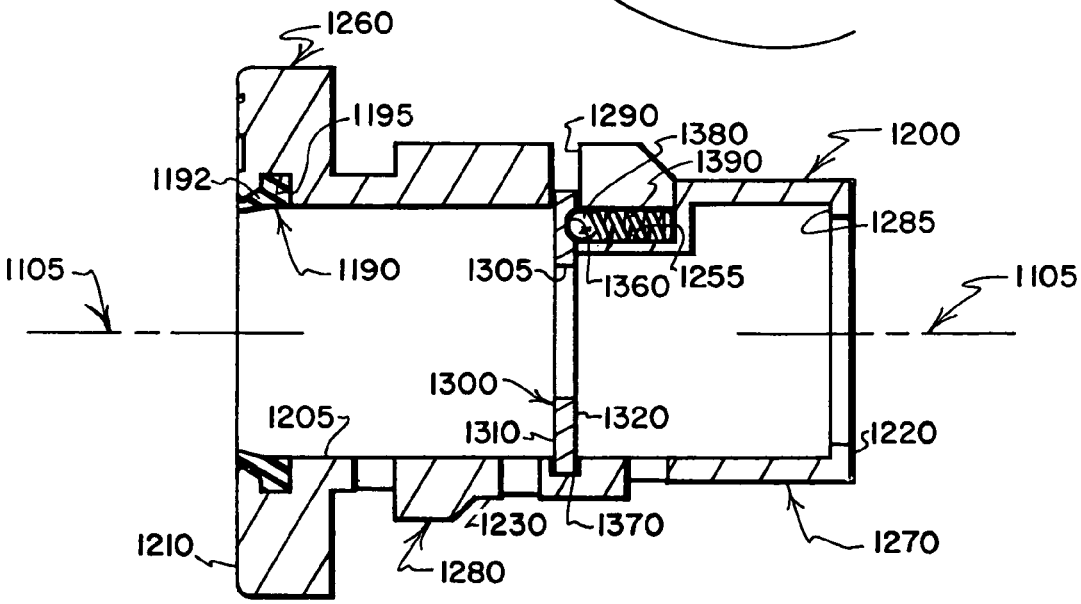
FIG. 20 is a sectional view schematically depicting an alternate arrangement of detent components for a push button actuator unit.

Referring to FIGS. 20–22, a rearwardly-facing stop surface 523 is defined by the primary front element 520 near the front end of the C-shaped cross-section of the rear portion 524. When front elements of the push button sub-assembly 500 are depressed rearwardly along the central axis 105, the stop surface 523 may be caused to engage the front surface 310 of the disc-shaped member 300 to "stop" rearward translation of the primary front element 520. Because the disc-shaped member 300 is of sturdy construction and has much of its periphery nested in and securely supported by portions of the housing 200 that define the transversely extending slot 290, the engagement of the stop surface 523 of the primary front element 520 with the front face 310 of the disc-shaped member 300 provides a very secure means of "stopping" the rearward depression of front elements of the push button sub-assembly 500—a simple arrangement that is highly resistant to hammering of front elements of the push button sub-assembly 500 if attempts are made to defeat or break the push button actuator unit 100 by hammering front elements of the push button sub-assembly 500.

Referring to FIGS. 3, 6, 9 and 12 in conjunction with FIG. 21, the rear plunger element 580 has a generally cylindrical forwardly-extending front portion 582, a relatively small diameter rearwardly-extending rear portion 584 that defines a rear engagement surface 587, and a central portion 586 configured to connect the front and rear portions 582, 584. The front portion 582 of the rear plunger element 580 is inserted into the open rear end region of a generally cylindrical rear portion 564 of the primary rear element 560, and is held in place by connecting pins 585 installed in aligned holes formed through the front portion 582 and through the rear portion 564.

The rear engagement surface 587 of the rear plunger element 580 is provided for the purpose of engaging an operating element (not shown) of a device that is to be operated by the push button actuator unit 100 (or that is to have its operation initiated by or influenced by the push button actuator unit 100) when "unlocked" elements of the push button sub-assembly 500 are depressed to move the engagement surface 587 rearwardly (so as to cause an operating element to move from one position to another). Operating elements typically moved from one position to another by push button actuator units (such as an operating element of a latch, or an element that causes a set of latches to release so an associated closure can open) are well known to those who are skilled in the art, as is exemplified by the mechanisms depicted in patents assigned to The Eastern Company that include U.S. Pat. Nos. 6,755,449, 6,543,821, 6,454,320, D-474,673, D-472,449, D-471,427, D-471,426, D-467,786, D-464,555, D-463,247 and D-447,042, the disclosures of which are incorporated herein by reference.

Referring to FIGS. 3, 6, 9 and 12, the rear spring element 570 extends about the cylindrical rear portion 564 of the primary rear element 560. Front portions of the rear spring element 570 engage a rearwardly-facing surface 561 (see FIGS. 21, 22) of the annular front flange 562 of the primary rear element 560. Rear portions of the rear spring element 570 engage a forwardly facing annular interior surface of the back wall 285 of the housing 200. By this arrangement, the rear spring element 570 is positioned to bias the primary rear element 560 (and the rear plunger element 580 which is rigidly connected to the primary rear element 560 by the pins 585) forwardly toward a non-operated position depicted in FIGS. 3 and 9—a position wherein the front surface of the annular front flange 562 of the primary rear element 560 engages the rear surface 320 of the disc-shaped member 300 to "stop" forward movement of the primary rear element 560.

Rearward movement of the primary rear element 560 is stopped before the rear spring element 570 is compressed to an undesired degree by a threaded fastener 590 which has an inner end region that is threaded into a hole 529 (see FIG. 22) formed through the rear portion 524 of the primary front element 520, and which has an outer end region (an enlarged head of the fastener 590) that is received in a slip-fit within an axially extending slot 569 (see FIG. 22) defined by the primary rear element 560. When the outer end region of the fastener 590 comes into engagement with one of the curved end surfaces of the slot 569, rearward movement of the primary rear element 560 is "stopped."

Referring to FIG. 21, the tumbler-carrying, keyway-defining plug 540 is an elongate member that has a conventionally configured front portion which, in a conventional manner well known to those who are skilled in the art, defines a keyway 542 that opens forwardly to receive a suitably configured key (not shown), and that provides transversely extending slots which carry a set of spring biased tumblers 544 configured in a conventional manner to engage portions of a key inserted into the keyway 542. A properly configured key inserted into the keyway 542 will retract the tumblers 544 in the usual and conventional manner from extending into grooves 526 (see FIGS. 19, 22) defined in the usual way along interior portions of the passage of a surrounding structure (in this case the passage 525 of the primary front element 520) so the plug 540 can turn between so-called "locked" and "unlocked" positions (in this case, the plug 540 turns about the axis 105 to orient the keyway either in an unlocked direction depicted in FIGS. 1–6, or in a locked direction depicted in FIGS. 7–12).

Figure 2:
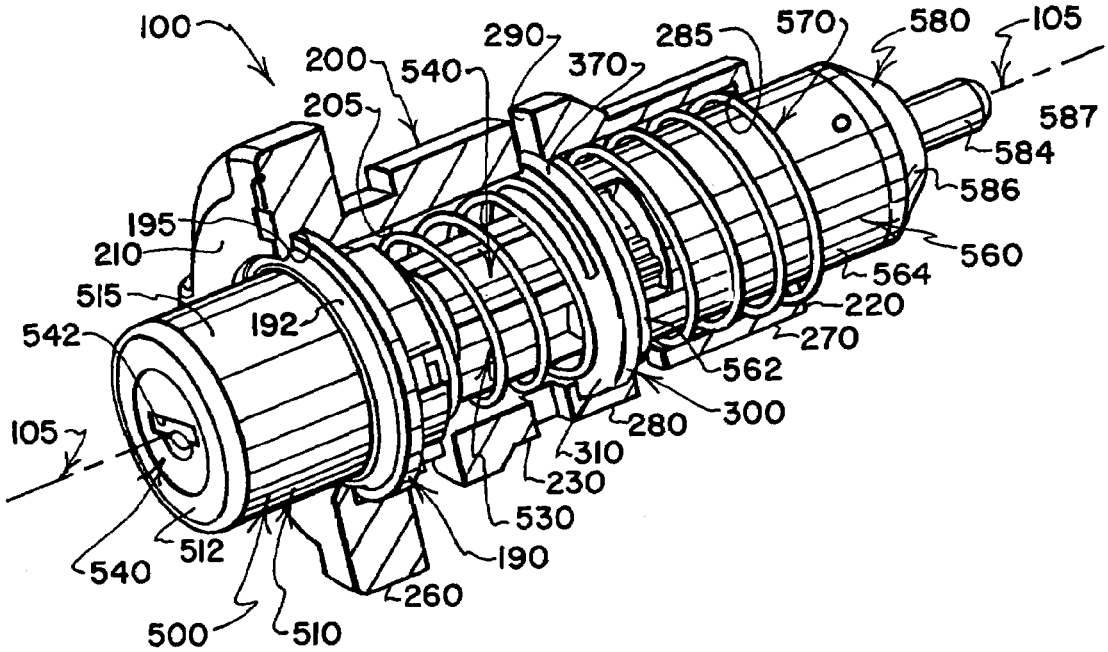
FIG. 2 is a perspective view thereof with portions broken away and shown in cross-section.
Figure 3:
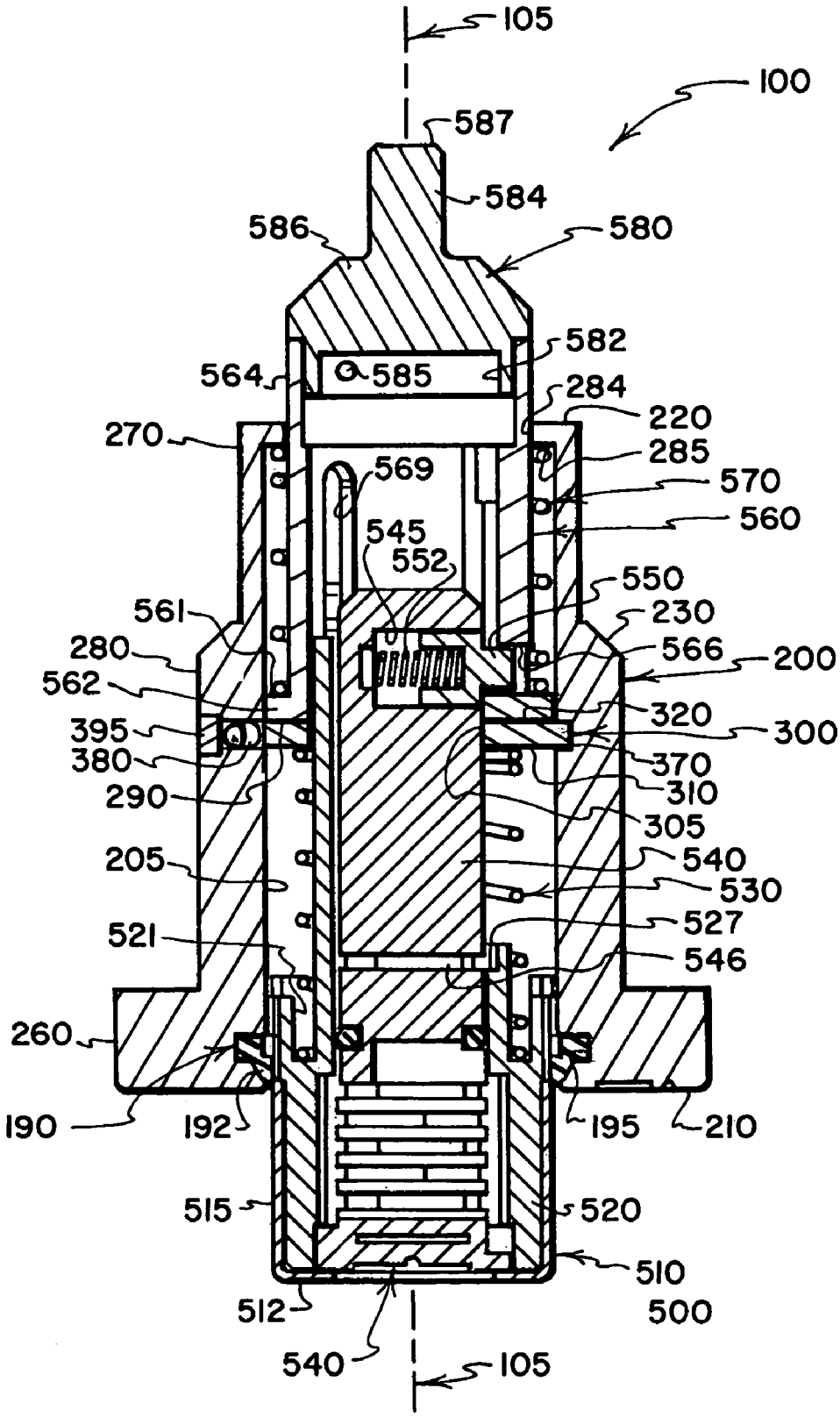
FIG. 3 is a sectional view as seen from a plane indicated by a line 3—3 in FIG. 1.
Figure 4:
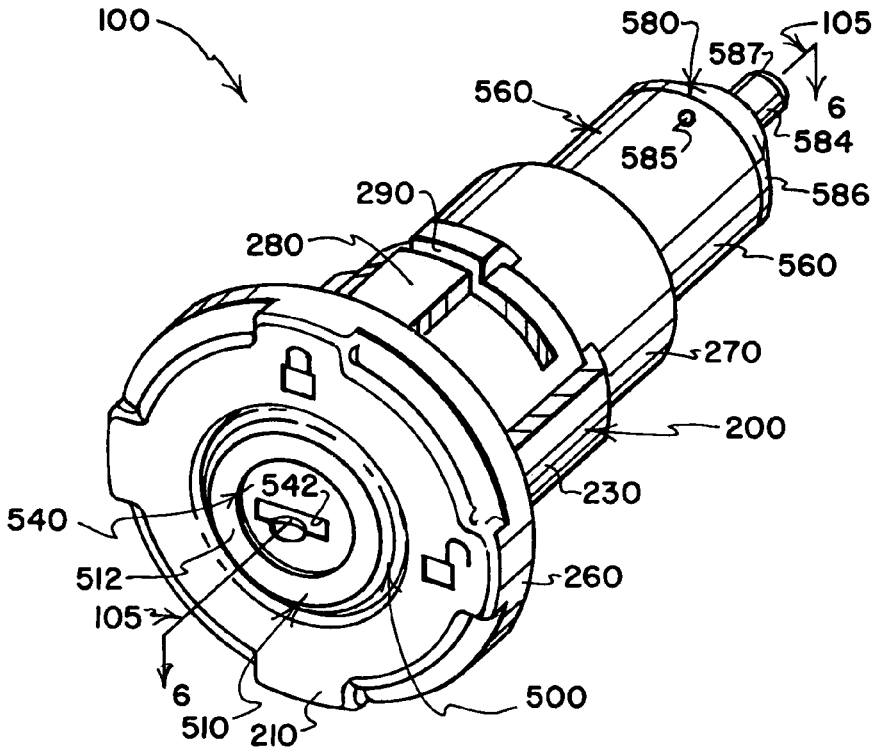
FIG. 4 is a perspective view similar to FIG. 1 but with the unlocked push button depressed causing the rear plunger portion of the push button to project rearwardly to an extended, operated position.
Figure 5:
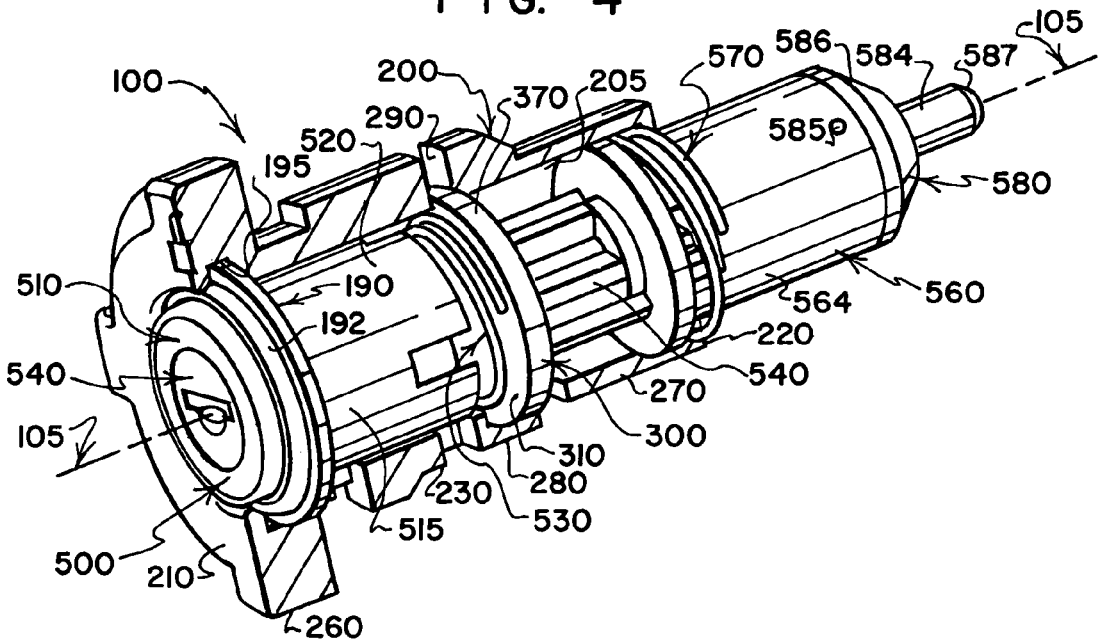
FIG. 5 is a perspective view thereof with portions broken away and shown in cross-section.
Figure 6:
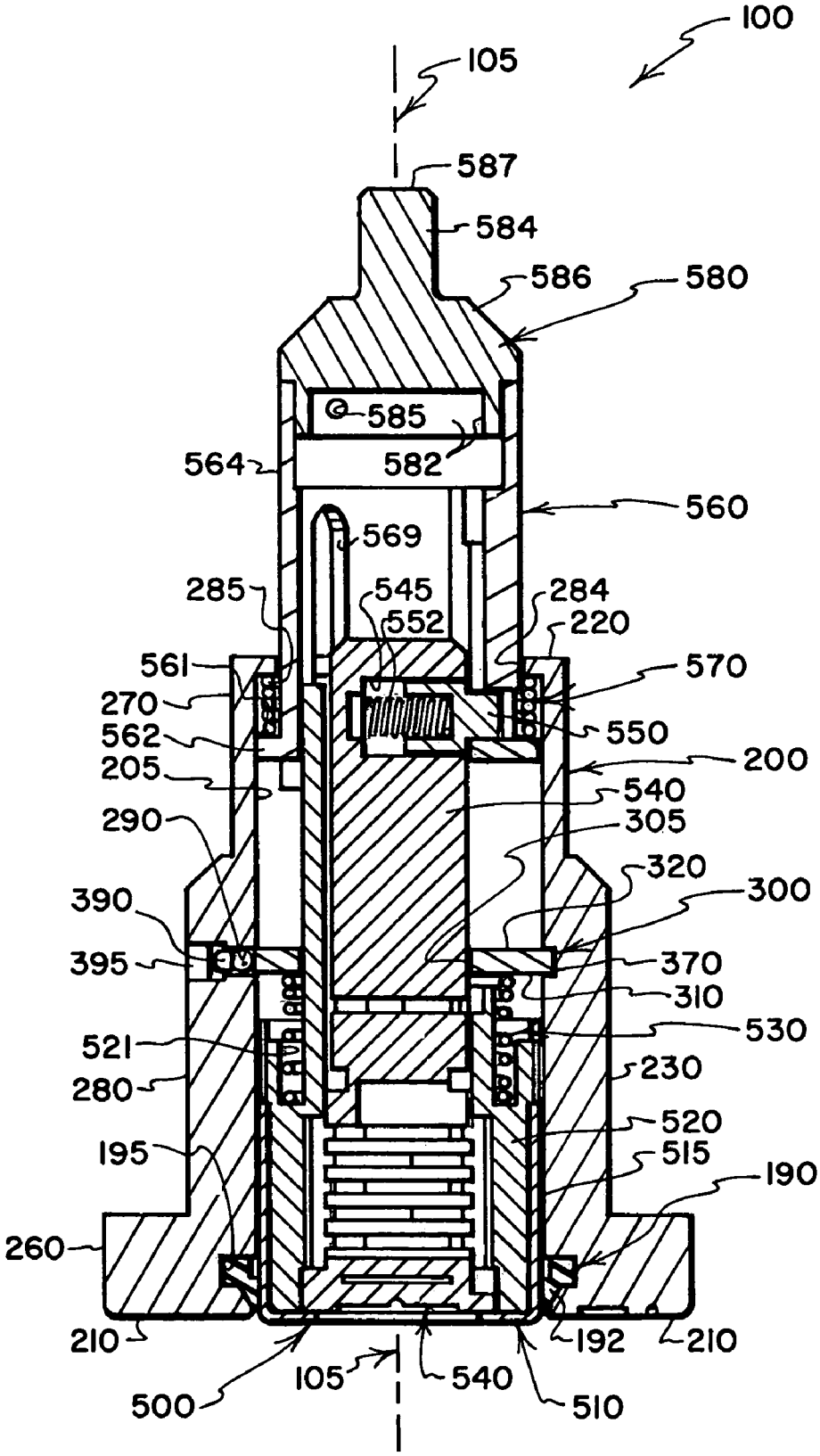
FIG. 6 is a sectional view as seen from a plane indicated by a line 6—6 in FIG. 4.

When the plug 540 is turned to put the keyway 542 in the unlocked orientation depicted in FIGS. 1–6, the bolt 550 carried by the plug 540 is oriented as depicted in FIG. 3 (where front portions of the push button sub-assembly 500 are in their normal, forwardly extended, non-depressed positions) or as depicted in FIG. 6 (where front portions of the push button sub-assembly 500 are shown in their depressed position). Because the plug 540 is "unlocked" as depicted in FIGS. 3 and 6, the spring-projected bolt 550 does nothing to "latch" any of the elements of the push button sub-assembly 500 to prevent their forward or rearward movement along the axis 105.

Figure 7:
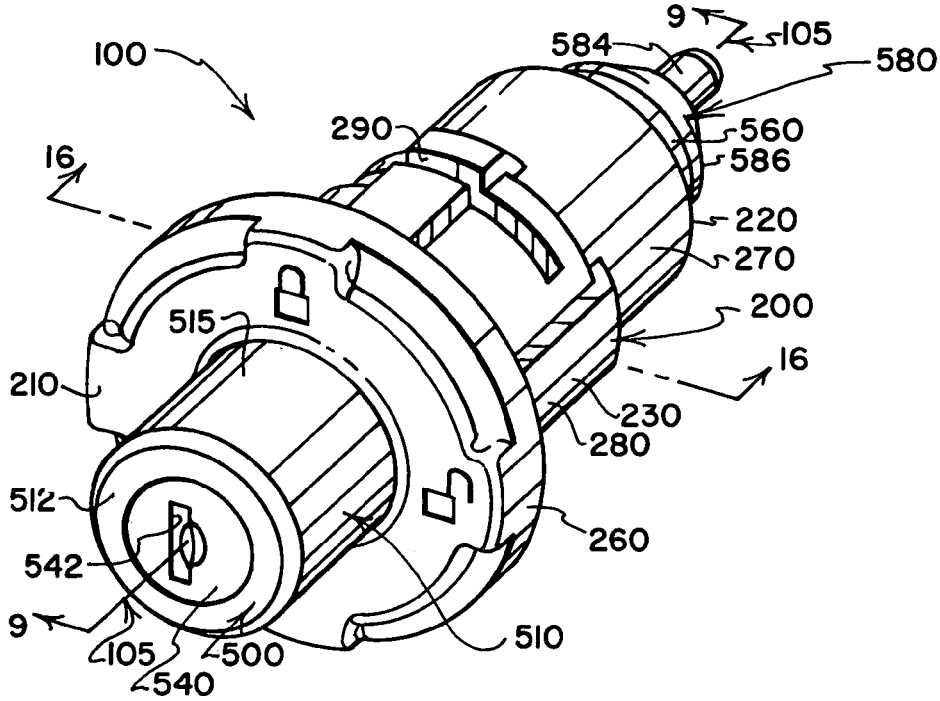
FIG. 7 is a perspective view similar to FIG. 1 but with the keyway of the push button turned to a locked position, it being seen that the push button has not been depressed, and that the rear plunger is therefore in its normal non-extended, non-operated position.
Figure 8:
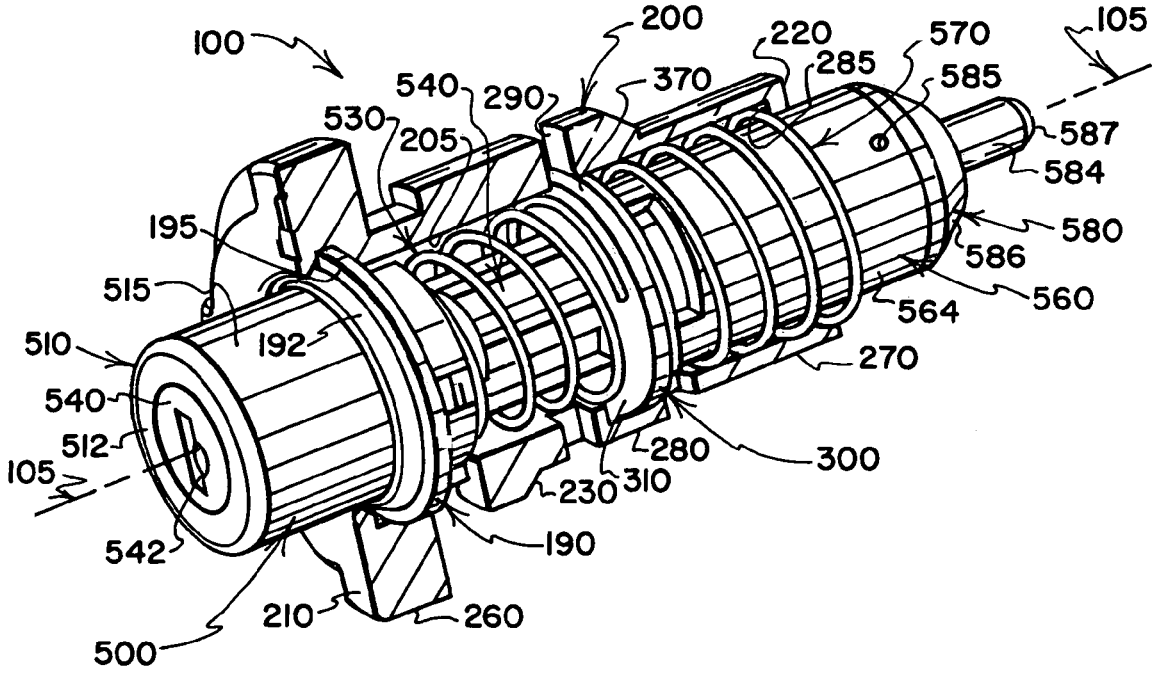
FIG. 8 is a perspective view thereof with portions broken away and shown in cross-section.
Figure 9:
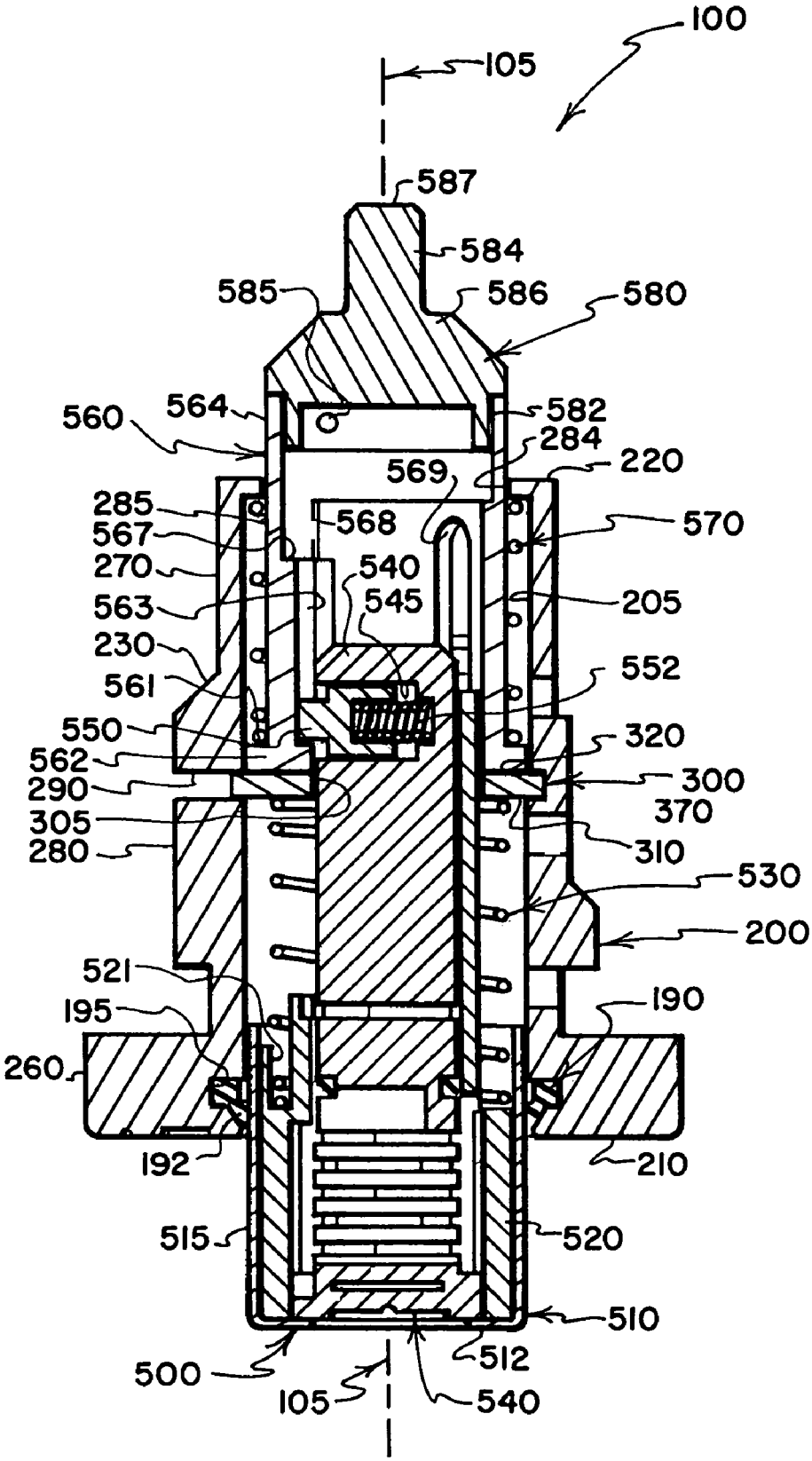
FIG. 9 is a sectional view as seen from a plane indicated by a line 9—9 in FIG. 7.
Figure 10:
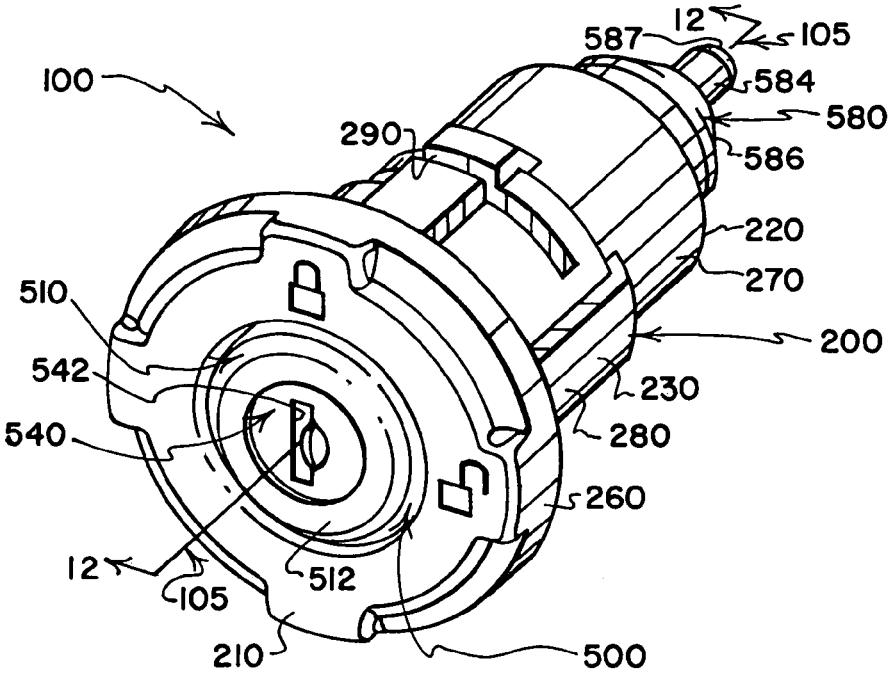
FIG. 10 is a perspective view similar to FIG. 7 but with the locked the push button depressed, it being seen that depression of the locked push button causes no corresponding rearward movement of the rear plunger which remains in its normal, non-extended, non-operated position.
Figure 11:
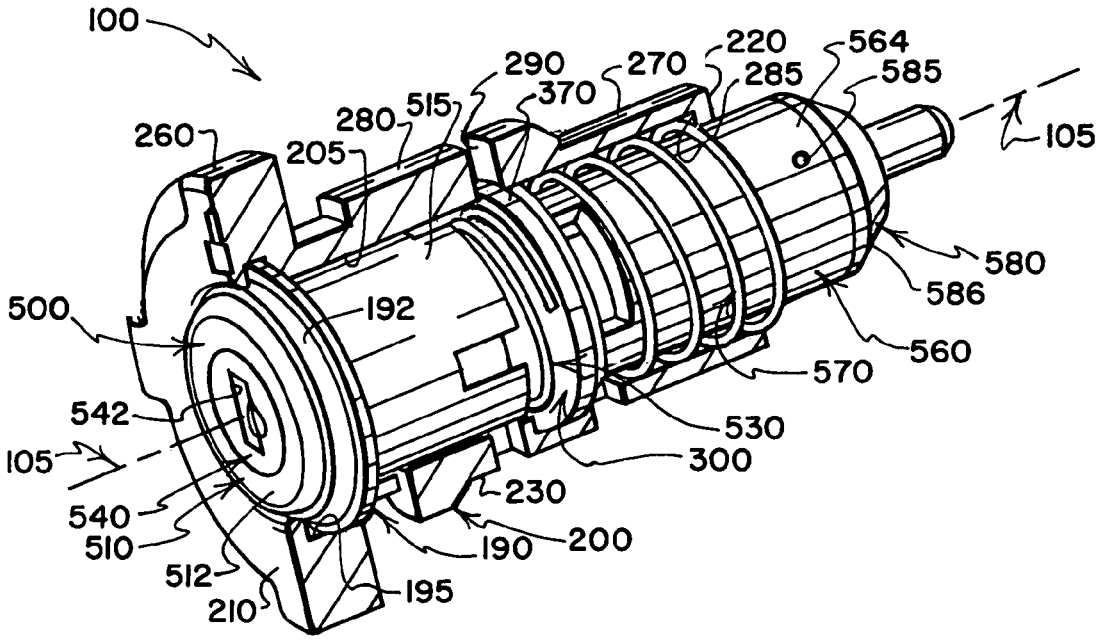
FIG. 11 is a perspective view thereof with portions broken away and shown in cross-section.
Figure 12:
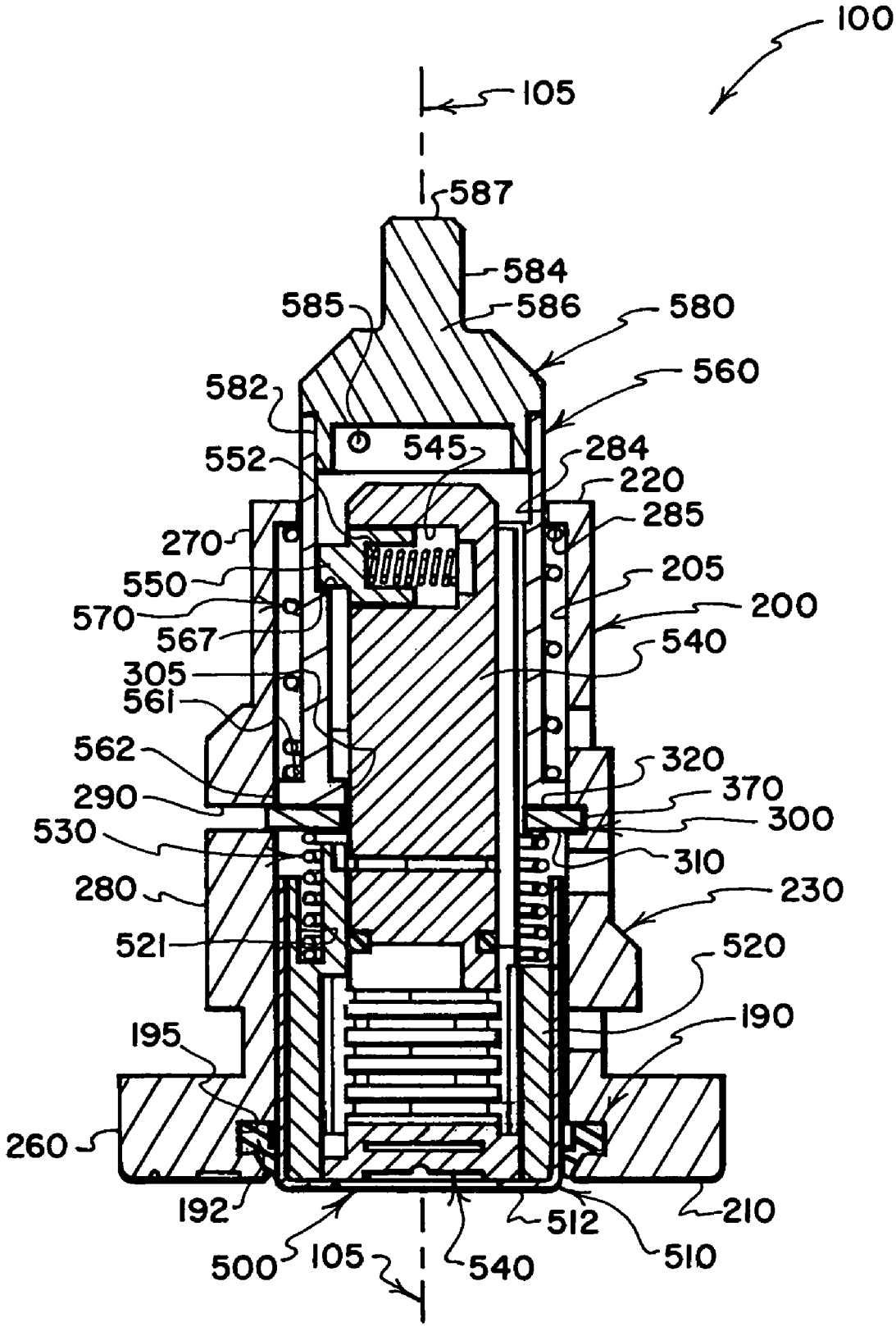
FIG. 12 is a sectional view as seen from a plane indicated by a line 12—12 in FIG. 10.

When the plug 540 is turned to put the keyway 542 in a locked orientation depicted in FIGS. 7–12, the spring-projected bolt 550 carried by the plug 540 is oriented as depicted in FIG. 9 (where front portions of the push button sub-assembly 500 are in their normal, extended, non-depressed positions) or as is depicted in FIG. 12 (where front portions of the push button sub-assembly 500 are shown depressed). When in the position depicted in FIG. 12, the spring-projected bolt 550 extends behind a rearwardly facing shoulder 567 (see FIGS. 9, 12) of the primary rear element to prevent forward movement of the primary front element 520 (because the plug 540 and the primary front element 520 are connected by the retaining tumbler 546 of the plug 540, the front element 520 cannot move axially relative to the plug 540, therefore, when the bolt 550 latches the plug 540 so it cannot move forwardly, this latching of the plug 540 keeps the primary front element 520 from moving forward too). However, when the plug 540 is turned from the position of FIG. 12 to an unlocked position, a short, curved, ramp-like formation 568 (see FIG. 9) on the interior of the primary rear element 560 cams the bolt 550 inwardly just enough so it no longer extends behind the shoulder 567, which lets the bolt 550 move forwardly along the passage 563 (see FIG. 9) as the primary front element 520 also moves forwardly to the normal position depicted in FIG. 3.

When the plug 540 is turned to the locked orientation as depicted in FIGS. 7–12, front elements of the push button sub-assembly 500 may remain in the normal, non-depressed, non-operated position shown in FIGS. 7–9, or may be depressed rearwardly to the position shown in FIGS. 10–12. However, rearward movement of the primary front element 520 while components are in the locked position depicted in FIGS. 7–9 will not cause rearward movement of the primary rear element 560 (nor will it cause rearward movement of the rear plunger element 580 which is pinned to the rear element 560) because, in the unlocked position of FIGS. 7–9, the bolt 550 does not drivingly connect the front and rear elements 520, 560 for concurrent axial movement. If the front elements are depressed from the non-operated position while the keyway 542 is in the locked orientation of FIGS. 7–9, the front elements then will be retained in the depressed position depicted in FIGS. 10–12 (due to the bolt 550 extending behind the shoulder 567 as described just above) unless and until a suitably configured key is inserted into and turned a quarter turn in the keyway 542 to reposition the keyway 542 to its unlocked orientation (which permits the bolt 550 to move forwardly as described just above).

When the various components of the push button actuator unit 100 depicted in FIG. 21 are to be assembled, the recommended assembly procedure involves several steps. The resilient wiper washer 190 is inserted into the open front end region of the housing passage 205 and moved into the housing-defined groove 195 to the position depicted in FIGS. 3, 6, 9 and 12. The rear plunger element 580 is installed on the rear end region of the primary rear element 560 using the connecting pins 585. The rear spring element 570 is inserted through the front open end region of the housing passage 205, followed by the assembly of the primary rear element 560 and the rear plunger element 580, and the primary rear element 560 is pressed rearwardly into the housing 205, in opposition to the biasing action of the rear spring element 570 to position the front flange 562 of the primary rear element behind where the slot 290 extends transversely through the central portion 230 of the housing 200. With the primary rear element depressed to the afore-described position, the disc-shaped member 300 is inserted into the slot 290 and turned to align features of its opening 305 with corresponding features of the opening 565 of the primary rear element 560. Once the disc-shaped member 300 is in place in the slot 290, the front spring element 530 is inserted through the front open end region of the housing passage 205, and the primary front element 520 is inserted into the housing passage 205 in a manner that causes the C-shaped cross-section of the rear portion 524 to pass through the coils of the spring element 530 and into the larger "halves" of the aligned openings 305, 565.

If the central opening formed in the front wall 512 of the front cover element 510 is large enough to permit the tumbler-carrying, keyway-defining plug 540 to pass there-through, the cover 510 can be installed on the cylindrical front portion 522 of the primary front element 520 even before the primary front element 520 is inserted into the housing passage 205. However, if the plug 540 cannot pass through the opening defined by the front wall 512 of the front cover element 510, the front cover element 510 must be installed on the primary front element 520 after the plug 540 is inserted into a central passage 525 of the primary front element 520 in a manner that is described shortly.

Assembly of the elements of the push button sub-assembly 500 is continued by inserting the threaded fastener 590 through a housing side wall opening (not shown) and through the axially extending slot 569 (see FIG. 22) of the primary rear element 560 so the inner end region of the fastener 590 can be threaded into the hole 529 (see FIG. 22) formed in the rear portion of the primary front element 520. Once the inner end region of the fastener 590 is threaded into the hole 529, the relatively large head-defining outer end region of the threaded fastener 590 extends in a slip fit into the slot 569 to provide a fastener-movable-in-slot connection that permits the primary front element 520 to move forwardly only a limited distance (i.e., to the normal non-depressed position depicted in FIGS. 1–6) i) because the primary front element 520 can not move farther forward once the head of the fastener 590 engages a rounded end region of the slot 569, and ii) because the primary rear element cannot move any farther in a forward direction once the front flange 562 of the primary rear element 560 engages the rear surface 320 of the disc-shaped member 300.

Continued assembly of the elements of the push button sub-assembly 500 includes the steps of inserting the compression coil spring 552 and the bolt 550 into the transversely extending passage 545 of the plug 540. With the bolt 550 depressed into the passage 545 in opposition to the action of the spring 552, and with the retaining tumbler 546 depressed as may be needed, the plug 540 is inserted into the passage 525 of the primary front element 520 to a position where the retaining tumbler 546 can move radially outwardly to the extent needed to retain the plug 540 in the passage 525. The use of a spring-projected retaining tumbler carried by a keyway-defining plug is an approach well known to and widely utilized by designers of key-operated locking mechanisms, and serves to prevent the plug from being removed from a passage into which it has been inserted unless and until the retaining tumbler can be pressed or retracted back into central portions of the plug. In this case, an outer end region of the retaining tumbler 546 extends behind a rearwardly facing internal shoulder 527 of the primary front element 520 (see FIG. 3) to retain the plug 540 in the passage 525 of the primary front element 520.

Assembly of the components depicted in FIG. 21 is completed by inserting the steel ball detent member 380, a resilient ball-shaped biasing member 390 and a press fitted, knurled brass retaining plug 395 in the housing passage 255, and by turning the disc-shaped member 300 to align the recess 360 with the axis 285 of the passage 255 so a portion of the detent member 380 can then be biased by the biasing member 390 into the recess 360—by which arrangement the disc-shaped member 300 and elements of the push button sub-assembly 500 connected thereto are retained in position (inhibited from turning about the central axis 105) unless and until an overtorque force (a force of sufficient magnitude to override the detent action of the detent member 380 which is biased at least part-way into the recess 360 so as to obstruct turning of the disc-shaped member 300) is applied to elements of the push button sub-assembly 500, typically by gripping and turning front elements of the push button sub-assembly 500 with a pipe wrench or pliers, or by using a screwdriver, chisel or other bladed instrument inserted into the keyway 542 to apply torque to the plug 540.

In accordance with features of the preferred practice of the present invention, the disc-shaped member 300 is used to regulate (i.e., to limit, restrict, inhibit, resist or otherwise control) movement of selected elements of the push button sub-assembly 500 depicted in FIG. 21. One way in which the disc-shaped member 300 may serve a regulating function of this sort is to utilize one or both of the opposed side surfaces 310, 320 of the disc-shaped member 300 as "stops" or "stop surfaces" that can be engaged by elements of the push button sub-assembly 500 to limit element translation along the axis 105, as has been described above.

Another way in which the disc-shaped member 300 may serve a regulating function calls for the housing 200 to be provided with one or more detent members that are biased toward engaging the disc-shaped member 300, such as the ball-shaped detent member 380 depicted in FIGS. 19 and 21 which is pressed by a resilient member 390 toward the disc-shaped member 300 so a portion of the ball-shaped detent member 380 can be received in a recess 360 formed in the circumferentially extending surface 370 of the disc-shaped member 300 to detent (i.e., to inhibit) the disc-shaped member 300 from turning about the central axis 105 relative to the housing 200. Because the primary front element 520 and the primary rear element 560 of the push button sub-assembly 500 are coupled to the disc-shaped member 300 by a splined type connection (features of which have been described above), the detenting action of the detent member 100 on the disc-shaped member 300 also serves to inhibit turning about the central axis 105 others of the elements of the push button assembly 500, for example the front and rear primary elements 520, 560.

The type of detent depicted in FIGS. 19 and 21 can be thought of as being "radial" in its arrangement inasmuch as the detent member 380 and the biasing member 390 are carried in a housing passage 255 which extends radially with respect to the center axis 105 (i.e., along the axis 285 which extends along a radius of an imaginary circle centered about the axis 105 and residing in the plane of the transversely extending housing slot 290). What is depicted in a somewhat simplified and schematic manner in FIG. 20 is an alternate "axial" arrangement of detent components. In the arrangement of FIG. 20, a detent member 1380 and a biasing member 1390 (a compression coil spring) are arranged to extend along an axis that substantially parallels the central axis 105, but at a distance spaced from the central axis 105.

Whereas the radial detent arrangement of FIGS. 19 and 21 uses a ball-shaped detent member 380 arranged to engage a recess 360 that is formed in a circumferentially extending peripheral surface 370 of the disc-shaped member 300, the axial detent of FIG. 20 uses a ball-shaped detent member 1380 arranged to engage a side surface 1320 of a disc-shaped member 1300. A concept illustrated by the schematic depiction of FIG. 20 is that detents employed to engage recesses formed in a disc-shaped member (such as the disc-shaped member 300 of FIGS. 19 and 21, and the disc-shaped member 1300 of FIG. 20) need not move along axes that extend radially with respect to a central axis of the detent member, such as the axis 105 of FIGS. 19 and 21, or the axis 1105 of FIG. 20.

So that significant portions of the description presented above do not need to be repeated in order for the reader to understand what is disclosed in the somewhat schematic depiction of FIG. 20, such reference numerals as are used in FIG. 20 (to designate features that correspond in function to features discussed in conjunction with FIGS. 1–19, 21 and 22) "correspond" to reference numerals used in FIGS. 1–19, 21 and 22 except that the numerals used in FIG. 20 are increased by a magnitude of one thousand. Because FIG. 20 employs reference numerals that "correspond" (to numerals used elsewhere herein) to designate functions and features that "correspond" (to functions and features designated by corresponding numerals employed in FIGS. 1–19, 21 and 22) it is unnecessary to repeat much of the description presented above that is applicable to reference numerals that "correspond" to the numerals employed in FIG. 20.

Descriptions pertinent to features of FIGS. 1–19, 21 and 22—descriptions that use reference numerals that differ by a magnitude of one thousand from the reference numerals used in FIG. 20—will be understood by the reader to be applicable to what is shown in FIG. 20 and designated by numerals larger by a magnitude of one thousand than reference numerals used in other drawing views. Thus, in FIG. 20, the disc-shaped member 1300 will be understood to correspond in function and purpose to the disc-shaped member 300 found in other views; the recess 1360 in the disc-shaped member 1300 will be understood to correspond in function and purpose to the recess 360 in the disc-shaped member 300 found in other views; and so on.

Figure 13:
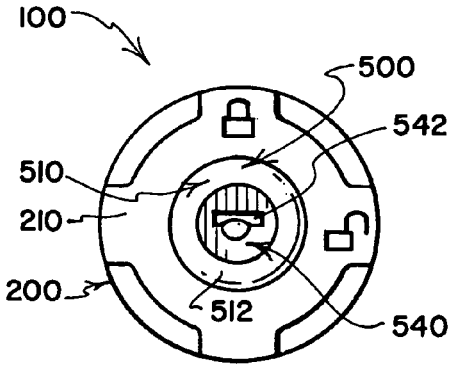
FIG. 13 is a front view of the push button actuator unit of FIG. 1 wherein the keyway of the push button is turned to the unlocked position.
Figure 14:
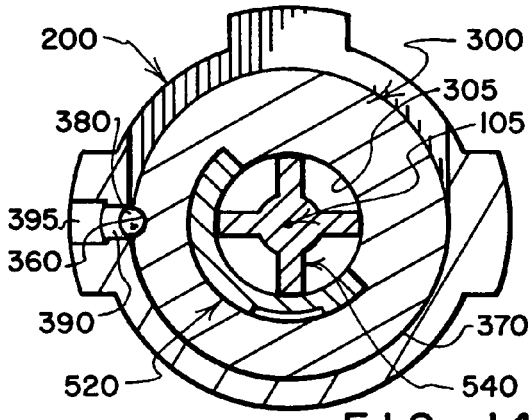
FIG. 14 is a sectional view, on an enlarged scale, as seen from a plane indicated by a line 14—14 in FIG. 1 showing detent components of the unlocked push button actuator.

What is depicted in FIG. 13 is the appearance of front portions of the push button actuator unit 100 when the keyway 542 is turned to the unlocked position. What is depicted in FIG. 14 illustrates the normal position of the steel ball detent member 380 and the resilient ball biasing member 390 when components of the unit are arranged as depicted in FIG. 13. As can be seen, the detent member 380 extends into the recess 360 of the disc-shaped member 300 to inhibit turning of the disc-shaped member 380 about the center axis 105.

Figure 15:
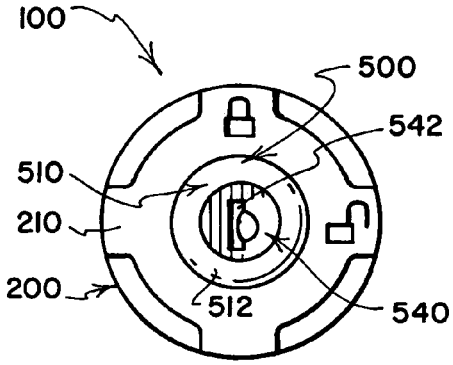
FIG. 15 is a front view of the push button actuator unit of FIG. 7 wherein the keyway is turned to the locked position.
Figure 16:
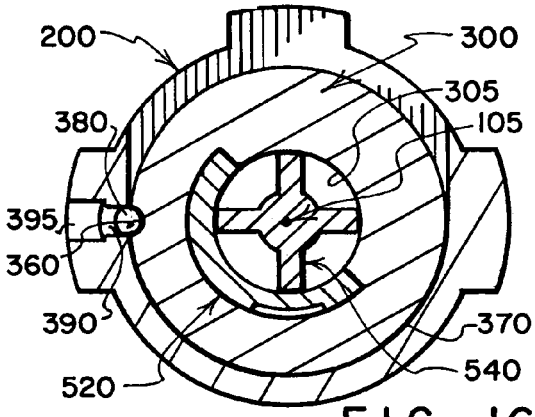
FIG. 16 is a sectional view, on an enlarged scale, as seen from a plane indicated by a line 16—16 in FIG. 7 showing the detent components positioned exactly the same as these same components are positioned in FIG. 14.

What is depicted in FIG. 15 is the appearance of front portions of the push button actuator unit 100 when the keyway 542 is turned to the locked position. What is depicted in FIG. 16 illustrates the normal position of the steel ball detent member 380 and the resilient ball biasing member 390 when components of the unit are arranged as depicted in FIG. 15. As can be seen, the detent member 380 extends into the recess 360 of the disc-shaped member 300 to inhibit turning of the disc-shaped member 380 about the center axis 105—a component arrangement that is substantially identical to the component arrangement illustrated in FIG. 14.

Figure 17:
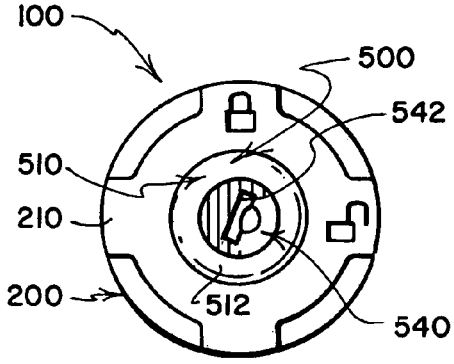
FIG. 17 is a front view of the locked push button actuator but with components of the push button sub-assembly forcibly turned from their locked position.

What is depicted in FIG. 17 is the appearance of front portions of the push button actuator unit 100 when the keyway 542 has been turned from the locked position of FIG. 15 by inserting a screwdriver, chisel or other bladed device (not shown) into the keyway 542 and applying a torque overload force that causes the plug 540 to turn about the axis 105 which, in turn, causes other spline-connected components of the unit 100 to turn about the axis 105, including the disc-shaped member 300. When the disc-shaped member 300 is forced to turn about the axis 105 relative to the housing 200, this causes the steel ball detent member 380 to be forced out of the recess 360 of the disc-shaped member 300, as is depicted in FIG. 18—an arrangement that permits the disc-shaped member 300 (and elements of the push button sub-assembly 500 that are connected to the disc-shaped member 300 by the afore-described spline-type connection) to also "free wheel" (i.e., to turn in a substantially unrestricted, substantially unrestrained, substantially uninhibited manner) because the detent element 380 is no longer performing its detent function.

Figure 18:
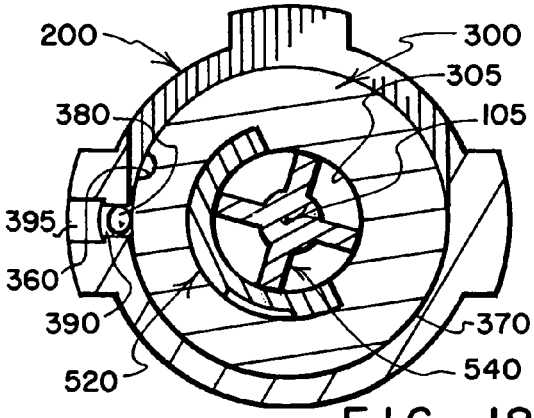
FIG. 18 is a sectional view on the scale of FIGS. 14 and 16 and similar to FIGS. 14 and 16 but showing detent components of the push button actuator unit positioned as may appear when the plug of the push button sub-assembly has been turned to the orientation depicted in FIG. 17 by force sufficient magnitude to override the normal detenting action of the detent components.

When the disc-shaped member 300 is forced by overtorque to turn as depicted in FIG. 18, the ball-shaped biasing member 390 is compressed. If the material used to form the biasing member 390 is sufficiently resiliently compressible without being damaged, then the biasing member 390 may cause the detent member 380 to be biased back into the recess 360 of the disc-shaped member 300 when the disc-shaped member is turned to an orientation that aligns the recess 360 with the passage 255 that houses the detent member 380. If, on the other hand, the material used to form the biasing member 390 is crushed or otherwise permanently deformed when the detent member 380 is forced out of the recess 360 due to an application of overtorque force to components of the push button sub-assembly 500, the detent member 380 probably will not "reset" or resume its normal detenting function even when the recess 360 is aligned with the passage 255 in a way that permits the ball-shaped detent member 380 to move back into the recess 360.

In preferred practice, the biasing member 390 is formed from a ball-shaped piece of a resilient nitrile rubber material known as "Buna-N Nitrile"—a material that is quite resilient and can recover well when compressed. If crushing of the biasing member must be avoided, then the use of a compression coil spring, such as the spring 1390 shown in FIG. 20, is preferred.

What is not shown in FIG. 19 or 20, but which can be readily understood by those who are skilled in the art, is that more than one detent can be provided to more forcefully detent the disc-shaped member 300 (i.e., to more forcefully oppose turning of the disc-shaped members 300, 1300 about the central axes 105, 1105, respectively) where a greater detenting action is desired. If plural detents are utilized, they may, of course, be of either of the radial or axial types illustrated in FIGS. 19 and 20, or may take other forms that are well known to those who are skilled in the art.

Operation

With the components of the push button actuator unit 100 oriented as depicted in FIGS. 1–3, depression of front elements of the push button sub-assembly 500 to the position shown in FIGS. 3–6 will cause the front elements of the push button sub-assembly 500 (including the primary front element 520, the plug 540 and the plug-carried bolt 550) to move rearwardly along the central axis 105 of the passage 205 of the housing 200; and, because, as is seen in FIG. 3, the bolt 550 extends in front of a forwardly-facing shoulder 566 of the primary rear element 560 (the shoulder 566 is more clearly shown in FIG. 22), rearward movement of the primary front element 520, the plug 540 and the bolt 550 will cause the rear plunger element 580 to move rearwardly as is depicted in FIGS. 4–6—so the engagement surface 587 at the rear of the rear plunger element 580 can be used, for example to operate such apparatus as are disclosed in the above-referenced patents, as by moving an element engaged by the surface 587 from one position to another. Depression of elements of the push button sub-assembly 500 in the manner depicted in FIGS. 4–6 is opposed not only by the action of the front spring element 530 but also by the action of the rear spring element 570.

If, on the other hand, front elements of the push button sub-assembly 500 are depressed and caused to move rearwardly along the axis 105 of the housing 200 to the position depicted in FIGS. 10–12 at a time after the plug 540 has been turned to the locked position depicted in FIGS. 7–9, the bolt 550 is no longer positioned in front of the shoulder 566, and only front elements of the push button sub-assembly 500 (including the primary front element 520, the plug 540 and the bolt 550) will move rearwardly in opposition to the action of the front spring element 530 (the rear elements, including the primary rear element 560 and the rear plunger element 580, will not move rearwardly because the bolt 550 does not connect the front and rear elements to cause rearward movement of the rear elements in response to rearward movement of the front elements when the plug 540 is turned to the locked position of FIGS. 7–9 before the front elements are depressed to the position shown in FIGS. 10–12.

If, while locked, elements of the push button sub-assembly 500 are subjected to torque of sufficient magnitude to cause the action of the detent 380 (or in a similar manner the detent member 1380) to be overcome, as depicted in FIG. 18 (which causes the detent member 380 or 1380 to move out of the associated recess 360 or 1360 of the associated disc-shaped member 300 or 1300 and so as to permit the elements of the associated push button sub-assembly to "free wheel" within the associated housing 200 or 1200 in response to torque force applied to elements of the associated push button sub-assembly), elements of the associated push button sub-assembly are not then significantly inhibited or prevented by the detent 380 or 1380 from turning about the axis 105 or 1105, which is to say that the elements of the associated push button sub-assembly are permitted to "free wheel"—to turn harmlessly without causing rearward movement of rear plunger element—within the housing 200 or 1200 regardless of whether front elements of the associated push button sub-assembly are depressed or not.

This "free wheeling" or free-to-turn status of push button sub-assembly elements will continue unless and until the disc-shaped member 300 or 1300 is returned to a position where the recess 360 or 1360 aligns with a housing passage 255 or 1255 in which the detent member 380 or 1380 and the biasing member 390 or 1390 is carried, which permits the normal detent action of the detent member 380 or 1380 to reestablish unless the biasing capability of the biasing member 390 or 1390 has been damaged or depleted due to crushing of the biasing member 390 or 1390 in a manner that prevents the biasing member 390 or 1390 from exerting on the detent member 380 or 1380 a biasing force of sufficient magnitude to cause a portion of the detent member 380 or 1380 to move into and to seat within the recess 360 or 1360 of the disc-shaped member 300 or 1300, respectively.

In some applications, it is desirable that the push button actuator unit 100 provide some indication that elements of its push button sub-assembly 500 have been subjected to excessive torque. In such applications, it may be desirable to form the biasing member 390 from a resilient material that is crushable and rendered partially or fully inoperative if elements of the push button sub-assembly 500 are forced to "free wheel," so that proper operation of the associated detent member 380 cannot be fully restored or reset without replacing the biasing member 390. The lack of a properly functioning biasing member 390 will be readily apparent to the user, and will provide notice to the user that the push button actuator unit requires service or should be replaced.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that the patent shall cover by suitable expression in the appended claims whatever features of patentable novelty exist in the invention disclosed.

What is claimed is:

1. A push button actuator, comprising:

a) a housing having an outer wall surrounding a passage extending forwardly-rearwardly through the housing along a central axis, with a slot formed through the outer wall of the housing extending transverse to the central axis and communicating with the passage;

b) a disc-shaped member carried in the slot and defining an opening that aligns with the passage;

c) a push button sub-assembly supported in the passage of the housing and extending through the opening of the disc-shaped member, including a front element movable along the central axis between opposed ends of a first range of permitted movement, and a rear element movable along the central axis between opposed ends of a second range of permitted movement; and, d) wherein the disc-shaped member is engaged by at least a selected one of the front and rear elements when the selected one of the front and rear elements is at one end of the associated first and second range of permitted movement.

2. The push button actuator of claim 1 wherein the disc-shaped member is engaged by the front element when the front element is at one of the opposed ends of the first range of permitted movement, and wherein the disc-shaped member is engaged by the rear element when the rear element is at one of the opposed ends of the second range of permitted movement.

3. The push button actuator of claim 1 wherein the front element, the rear element and the disc-shaped member are provided with interfitting formations that cooperate to ensure substantially concurrent turning of the front element, the rear element and the disc-shaped member about the central axis relative to the housing.

4. The push button actuator of claim 1 wherein the push button sub-assembly further comprises a locking mechanism capable, when unlocked, of drivingly connecting the front and rear elements so that rearward movement of the front element along the central axis from a normal position to a depressed position will cause rearward movement of the rear element from a non-operated position to an operated position.

5. The push button actuator of claim 4 wherein the locking mechanism is capable, when locked, of retaining the front element in the depressed position if the front element is moved from the normal position to the depressed position while the locking mechanism is locked.

6. The push button actuator of claim 5 wherein the locking mechanism is capable of releasing the front element for forward movement from the depressed position to the normal position when a suitably configured key is inserted into and turned while inserted into a keyway of the locking mechanism to unlock the locking mechanism.

7. The push button actuator of claim 1 wherein the disc-shaped member defines a recess, and the housing carries a detent member that is biased toward the disc-shaped member to engage the recess to inhibit turning of the disc-shaped member about the central axis when the disc-shaped member is oriented so the recess can receive a portion of the detent member.

8. A push button actuator unit, comprising:

a) a generally tubular housing having a central passage formed therethrough to extend along a central axis of the housing;

b) a push button sub-assembly supported by the housing for translation along the central axis, with a portion of the sub-assembly extending into the central passage;

c) wherein the portion of the push button sub-assembly that extends into the central passage includes at least one front element that is coupled by a spline-type connection to at least one rear element, with the spline-type connection including a projecting formation of at least one of the front and rear elements that extends substantially parallel to the central axis and is received in a slip-fit by an matingly configured formation of the other of the front and rear elements to thereby permit relative translation along the central axis of the front and rear elements while coupling the front and rear elements for concurrent turning movement about the central axis;

d) an annular disc-shaped member inserted through a slot formed in a side wall of the housing to extend transversely across the passage to limit a range of translation along the central axis of at least a selected one of the front and rear elements, with the disc-shaped member having an opening formed centrally therethrough that is configured to receive the projecting formation in a slip fit that permits translation of the front and rear elements along the central axis relative to the disc-shaped member while ensuring that the disc-shaped member turns about the central axis substantially concurrently with the front and rear elements; and, e) a detent for permitting the front element, the rear element and the disc-shaped member to rotate about the central axis only as the result of an abnormally high torque being applied to at least a chosen one of the front element, the rear element and disc-shaped member, wherein the detent includes a detent member carried in a channel of the housing and biased toward engagement with the disc-shaped member to be received in a recess of the disc-shaped member when the disc-shaped member is turned about the central axis to align the recess with the channel of the housing.

9. The push button actuator unit of claim 8 wherein the disc-shaped member has two opposite sides, and the recess is defined by one of the two opposite sides.

10. The push button actuator unit of claim 8 wherein the disc-shaped member has a circumferentially extending surface that extends about the central axis, and the recess is defined by the circumferentially extending surface.

11. The push button actuator unit of claim 8 wherein the front element is translatable along the central axis between a normal position and a depressed position, and wherein the disc-shaped member has a surface that is engaged by the front element when the front element is in a selected one of the normal position and the depressed position.

12. The push button actuator unit of claim 11 additionally including a front compression coil spring that biases the front element toward the normal position.

13. The push button actuator unit of claim 8 wherein the rear element is translatable along the central axis between a non-operated position and an operated position, and wherein the disc-shaped member has a surface that is engaged by the rear element when the rear element is in a selected one of the non-operated position and the operated position.

14. The push button actuator unit of claim 13 additionally including a rear compression coil spring that biases the rear element toward the non-operated position.

15. The push button actuator unit of claim 8 wherein the front element can be depressed rearwardly along the central axis from a normal position to a depressed position, wherein the rear element can be moved rearwardly along the central axis from a non-operated position to an operated position, and wherein a locking mechanism is provided that, only when unlocked, serves to drivingly connect the front element and the rear element to cause the rear element to move from the non-operated position to the operated position in response to movement of the front element from the normal position to the depressed position.

* * * * *